US009732771B2

(12) United States Patent
Henrickson et al.

(10) Patent No.: US 9,732,771 B2
(45) Date of Patent: Aug. 15, 2017

(54) HYDRAULIC ROTARY ACTUATOR

(71) Applicant: Woodward, Inc., Fort Collins, CO (US)

(72) Inventors: Rhett S. Henrickson, Palmdale, CA (US); Robert P. O'Hara, Castaic, CA (US)

(73) Assignee: Woodward, Inc., Fort Collins, CO (US)

( * ) Notice: Subject to any disclaimer, the term of this patent is extended or adjusted under 35 U.S.C. 154(b) by 311 days.

(21) Appl. No.: 14/547,424

(22) Filed: Nov. 19, 2014

(65) Prior Publication Data

US 2015/0078882 A1 Mar. 19, 2015

Related U.S. Application Data

(63) Continuation of application No. 13/760,135, filed on Feb. 6, 2013, now Pat. No. 8,915,176.

(51) Int. Cl.

| | |
|---|---|
| ***F15B 15/12*** | (2006.01) |
| ***F01D 9/00*** | (2006.01) |
| ***F01D 9/04*** | (2006.01) |

(52) U.S. Cl.

CPC ..... *F15B 15/12* (2013.01); *F01D 9/00* (2013.01); *F01D 9/04* (2013.01); *Y10T 29/49245* (2015.01)

(58) Field of Classification Search

CPC ..... F15B 15/12

See application file for complete search history.

(56) References Cited

U.S. PATENT DOCUMENTS

| | | | | |
|---|---|---|---|---|
| 860,461 | A | 7/1907 | Germiner | |
| 1,116,974 | A | 11/1914 | Bergesen | |
| 2,362,703 | A * | 11/1944 | Kuttner | F04C 9/002 417/481 |
| 2,778,338 | A | 1/1957 | Shafer | |

(Continued)

FOREIGN PATENT DOCUMENTS

| | | | |
|---|---|---|---|
| CN | 2429672 | Y | 5/2001 |
| CN | 1693720 | A | 11/2005 |

(Continued)

OTHER PUBLICATIONS

European Search Report, European Application No. EP16162741.9, Aug. 5, 2016, 4 pages.

(Continued)

*Primary Examiner* — F. Daniel Lopez

(74) *Attorney, Agent, or Firm* — Fish & Richardson P.C.

(57) ABSTRACT

A hydraulic rotary actuator including a stator housing having a through bore to position a rotor assembly. A rotor assembly includes an output shaft and at least a first rotary piston member disposed radially about the output shaft. The rotary piston member includes an vane element. A continuous seal is disposed on peripheral longitudinal faces and lateral end faces of the rotary piston element. The bore through the stator housing includes an interior cavity with surfaces adapted to receive the rotor assembly and contact the continuous seal. With rotation fluid ports blocked, the housing cavity is sealed with the continuous piston seal for hydraulic blocking, preventing actuator displacement by external forces. A method of operation and method of assembly is disclosed.

27 Claims, 15 Drawing Sheets

(56) References Cited

U.S. PATENT DOCUMENTS

| | | | |
|---|---|---|---|
| 2,951,470 | A | 9/1960 | Self |
| 2,966,144 | A | 12/1960 | Self |
| 2,984,221 | A | 5/1961 | Voorhees |
| 3,053,236 | A | 9/1962 | Self et al. |
| 3,207,048 | A | 9/1965 | Rumsey |
| 3,419,114 | A | 12/1968 | Rumsey |
| 3,554,096 | A | 1/1971 | DeJager |
| 3,659,503 | A | 5/1972 | Ehluss et al. |
| 3,688,645 | A | 9/1972 | Reaves |
| 4,009,644 | A | 3/1977 | Higuchi et al. |
| 4,027,576 | A | 6/1977 | Nomura |
| 4,471,967 | A | 9/1984 | Meyer |
| 4,565,119 | A | 1/1986 | Higuchi |
| 4,601,231 | A | 7/1986 | Shimoda |
| 4,823,678 | A | 4/1989 | Sollami |
| 5,054,374 | A | 10/1991 | Scobie et al. |
| 5,722,616 | A | 3/1998 | Durand |
| 6,520,068 | B1 | 2/2003 | Collier et al. |
| 7,441,493 | B2 | 10/2008 | Beetz et al. |
| 8,074,999 | B2 | 12/2011 | Burdick et al. |
| 2010/0283275 | A1 | 11/2010 | Amelsfoort |
| 2013/0309115 | A1 | 11/2013 | Thorwart et al. |

FOREIGN PATENT DOCUMENTS

| | | |
|---|---|---|
| DE | 1258275 | 1/1968 |
| DE | 2309959 | 8/1974 |
| GB | 1015462 | 12/1965 |
| JP | S50-22666 | 8/1975 |
| JP | S55078806 | 6/1980 |
| WO | WO2014105337 A1 | 7/2014 |

OTHER PUBLICATIONS

Written Opinion of the International Preliminary Examining Authority issued in International Application No. PCT/US2014/013275 on Mar. 18, 2015; 4 pages.

International Preliminary Report on Patentability issued in International Application No. PCT/US2014/013275 on May 21, 2015; 36 pages.

"Hydraulic rotary vane actuators", Micromatic LLC [online] [retrieved on Mar. 29, 2012] Retrieved from the Internet: <URL: http://www.micromaticllc.com/actuator-applications.aspx/hydraulic-rotary-vane-actuators, 1 page.

"Rotary Vane Actuator," Emerson Process Management [online] [retrieved on Mar. 29, 2012] Retrieved from the Internet: <URL: http://www2.emersonprocess.com/en-US/brands/shafer/valve_actuators/RV-Series/Pages/ . . . , 1 page.

Rotary-Actuator Image [online] [retrieved on Mar. 29, 2012] Retrieved from the Internet: <URL: http://images.grainger.com/B356_25/images/products/250x250/Rotary-Actuator-5PEY4 . . . , 1 page.

"Rotary Cylinders/Rotary Vane Actuators," Douce-Hydro, published on or before Oct. 2008, 2 pages.

International Search Report and Written Opinion of the International Searching Authority issued in International Application No. PCT/US2014/013275 on May 12, 2014; 13 pages.

Office Action issued in Chinese Application No. 201480020041.5 on Sep. 1, 2016; 25 pages.

* cited by examiner

HYDRAULIC ROTARY ACTUATOR

CLAIM OF PRIORITY

This application is a continuation of and claims the benefit of priority to U.S. patent application Ser. No. 13/760,135 filed on Feb. 6, 2013, the entire contents of which are hereby incorporated by reference.

TECHNICAL FIELD

This invention relates to an actuator device and more particularly to a pressurized hydraulic rotary actuator device wherein piston assemblies disposed about the rotor are moved by fluid under pressure.

BACKGROUND

Rotary actuators are used as part of some mechanical devices, to deliver rotary motion in an efficient manner and with the capability to maintain rotary position by blocking the hydraulic power fluid source. The ability to maintain a rotary position is desirable to control aircraft flight control surfaces and for other applications such as rotary valve assemblies. Rotary actuators are desirable because they maintain constant torque and conserve space. Such prior art rotary actuators typically include multiple subcomponents such as a rotor and two or more stator housing components. These subcomponents generally include a number of seals intended to prevent leakage of fluid out of the housing and/or between hydraulic chambers of such rotary valve actuators. Because of this leakage, prior art rotary actuators cannot maintain position by merely blocking the hydraulic power source, but maintain position by supplying additional make up fluid and constant control.

SUMMARY

In general, this document describes hydraulic rotary actuators with continuous seals disposed on peripheral surfaces of the pistons disposed in a housing.

In a first aspect, a hydraulic rotary actuator 1000 includes a stator housing 1002 comprised of a single seamless body having a bore disposed axially therethrough. The bore has a first end bore portion having a first diameter, a second end bore portion having a second diameter, and at least a middle bore portion disposed between the first end bore portion and the second end bore portion. The middle bore portion has a third diameter larger than the first diameter and a semi-cylindrical surface 1026 of the middle bore, and a first interior end surface 1030*a* between the middle bore portion and the first end bore portion, and a second interior end surface 1030*b* between said second bore portion and the middle bore portion. The middle bore further includes a first arcuate ledge disposed inward radially along a portion of a perimeter of the middle bore. The arcuate ledge has a fourth diameter less that the third diameter of the middle bore and a semi-cylindrical surface 1024. The rotary actuator 1000 further includes a rotor assembly 1100 including an output shaft 1008, and a first rotary piston member 1004*a* disposed radially about the output shaft. The first rotary piston member includes an elongated vane 1106*a*, a portion adapted to connect to the output shaft when the first rotary piston member is disposed radially about the output shaft, a first peripheral longitudinal face of the rotary piston member, a second peripheral longitudinal face of the rotary piston member, said second peripheral longitudinal face positioned axially on the elongated vane, a first peripheral lateral face, a second peripheral lateral face, a continuous seal groove disposed in the first and second peripheral longitudinal faces and the first and second peripheral lateral faces of the rotary piston member, and a continuous seal 1006*a* disposed in the continuous seal groove. When the rotor assembly 1100 is assembled and rotated in the bore of the stator housing, a portion of the continuous seal positioned in the seal groove along the first peripheral longitudinal face contacts the semi-cylindrical surface 1024 of the middle bore portion, a portion of the continuous seal positioned in the seal groove of the second peripheral longitudinal face contacts the semi-cylindrical surface 1026 of the arcuate ledge, a portion of the continuous seal positioned in the seal groove of the first peripheral lateral face contacts the first interior end surface, and a portion of the continuous seal positioned in the seal groove of the second peripheral face contacts the second interior end surface.

Various implementations can include some, all, or none of the following features. The rotary actuator further includes a second rotary piston member 1004*b* disposed radially about the output shaft 1008. The second rotary piston member includes an elongated vane 1106*a*, a portion adapted to connect to the output shaft when the first rotary piston member is disposed radially about the output shaft, a first peripheral longitudinal face of the rotary piston member, a second peripheral longitudinal face of the rotary piston member, said second peripheral longitudinal face positioned axially on the elongated vane, a first peripheral lateral face, a second peripheral lateral face, a continuous seal groove disposed in the first and second peripheral longitudinal faces and the first and second peripheral lateral faces of the rotary piston member, and a continuous seal disposed in the continuous seal groove. The elongated vane of the first rotary piston member and the elongated vane of the second rotary piston member are disposed longitudinally adjacent to each other and parallel to a longitudinal axis of the output shaft. The rotary piston members 1004*a*, 1004*b* are adapted to pass through the first end bore portion before being coupled to the rotor output shaft 1008 in the middle bore portion shaft. Each rotary piston member includes a plurality of slots 1104 adapted to receive a plurality of teeth 1102 on the rotor output shaft thereby coupling the rotary piston members to the rotor output shaft.

The first rotary piston member and the second rotary piston member and the stator housing define two adjacent pressure chambers inside of the middle bore portion. A first external pressure source provides a fluid at a first pressure for contacting the elongated vane of the first rotary piston member and a second external pressure source provides a fluid at a second pressure for contacting the elongated vane of the second rotary piston member.

The actuator further includes a third rotary piston member 1004*c* and a fourth rotary piston member 1004*d* each including a respective elongated vane member 1106, and wherein the stator housing 1002 and the first, second, third and fourth rotary piston members 1004*a-d* define four pressure chambers.

A first arcuate ledge disposed inward radially along a portion of the middle bore includes a first terminal end 1204 adapted to contact the elongated vane 1106 of the second rotary piston member 1004*b*. The middle bore portion includes a second arcuate ledge disposed inward radially along a portion of the middle bore portion and opposite the first arcuate ledge, said second arcuate ledge having a first terminal end 1206 adapted to contact the elongated vane 1106 of the first rotary piston member 1004*b*.

The elongated vanes of the rotary piston members 1004*a-d* and the two arcuate ledges are configured to define opposing pressure chambers. Each pair of opposing pressure chambers 1202*a*, 1202*b* defined by the housing and rotor have equal surface areas as the rotor rotates within the housing. A first pair of opposing pressure chambers is adapted to be connected to a first external pressure source and a second pair of opposing pressure chambers is adapted to be connected to a second external pressure source. The first external pressure source provides a fluid at a first pressure for contacting the elongated vane of the first rotary piston member and the second external pressure source provides a fluid for contacting the elongated vane of the second rotary piston member. The first terminal end of the first arcuate ledge further includes a first fluid port formed therethrough and the first terminal end of the second arcuate ledge includes a second fluid port formed therethrough and the first fluid port is connected to a fluid provided at a first pressure and the second fluid port is connected to a fluid provided at a second pressure.

The first diameter is greater than or equal to the second diameter. The second diameter is greater than or equal to the first diameter. The actuator of claim 1 wherein the continuous seals are selected from the group consisting of an O-ring, an X-ring, a Q-ring, a D-ring, and an energized seal. The output shaft is configured to connect to a rotary valve stem. The output shaft is adapted for connection to an aircraft control surface.

In a second aspect, a method of rotary actuation includes providing a stator housing 1002 comprising a single seamless body having a bore disposed axially therethrough, the bore having a first end bore portion having a first diameter, a second end bore portion having a second diameter, and at least a middle bore portion disposed between the first end bore portion and the second end bore portion, said middle bore portion having a third diameter larger than the first diameter and a semi-cylindrical surface 1026 of the middle bore, and a first interior end surface 1030*a* between the middle bore portion and the first end bore portion, and a second interior end surface 1030*b* between said second bore portion and the middle bore portion, said middle bore further including a first arcuate ledge disposed inward radially along a portion of a perimeter of the middle bore, said arcuate ledge having a fourth diameter less that the third diameter of the middle bore and a semi-cylindrical surface 1024. The method further includes providing a rotor assembly 1110 including an output shaft 1008, and a first rotary piston member 1004*a* disposed radially about the output shaft. The first rotary piston member includes an elongated vane 1106*a*, a portion adapted to connect to the output shaft when the first rotary piston member is disposed radially about the output shaft, a first peripheral longitudinal face of the rotary piston member, a second peripheral longitudinal face of the rotary piston member, said second peripheral longitudinal face positioned axially on the elongated vane, a first peripheral lateral face, a second peripheral lateral face, a continuous seal groove disposed in the first and second peripheral longitudinal faces and the first and second peripheral lateral faces of the rotary piston member, and a continuous seal 1006*a* disposed in the continuous seal groove. A first fluid at a first pressure contacts the elongated vane of the first rotary piston member with the first fluid and the rotor assembly rotates in a first direction of rotation.

Various implementations can include some, all, or none of the following features. When the rotor assembly is rotated in the bore of the stator housing, a portion of the continuous seal positioned in the seal groove along the first peripheral longitudinal face contacts the semi-cylindrical surface 1026 of the middle bore portion, a portion of the continuous seal positioned in the seal groove of the second peripheral longitudinal face contacts the semi-cylindrical surface 1024 of the arcuate ledge, a portion of the continuous seal positioned in the seal groove of the first peripheral lateral face contacts the first interior end surface, and a portion of the continuous seal positioned in the seal groove of the second peripheral face contacts the second interior end surface.

A second rotary piston member is disposed radially about the output shaft 1008, said second rotary piston member including an elongated vane 1106, a portion adapted to connect to the output shaft when the first rotary piston member 1004*b* is disposed radially about the output shaft, a first peripheral longitudinal face of the rotary piston member, a second peripheral longitudinal face of the rotary piston member, said second peripheral longitudinal face positioned axially on the elongated vane, a first peripheral lateral face, a second peripheral lateral face, a continuous seal groove disposed in the first and second peripheral longitudinal faces and the first and second peripheral lateral faces of the rotary piston member, and a continuous seal 1006*b* disposed in the continuous seal groove. A second fluid at a second pressure contacts the elongated vane of the second rotary piston member.

The second pressure is increased and the first pressure reduced until the second pressure is greater than the first pressure and the rotor assembly rotates in an opposite direction to the first direction of rotation. The rotation of the rotor assembly in the opposite direction is stopped by contacting a first terminal end of the first arcuate ledge with the elongated vane of the second rotary piston member.

The first rotary piston member 1004*a* and a second rotary piston member 1004*b* isolates the first fluid and second fluid into adjacent chambers, and providing the first fluid at the first pressure is provided to a first adjacent chamber and the second fluid at the second pressure is provided to a second adjacent chamber. A first terminal end of the first arcuate ledge further includes a first fluid port formed therethrough and a first terminal end of a second arcuate ledge includes a second fluid port formed therethrough, and wherein providing the first fluid at a first pressure is provided through the first fluid port and providing the second fluid at a second pressure is provided through the second fluid port. The rotation of the rotor assembly is stopped by contacting a first terminal end of the first arcuate ledge with an elongated vane of the first rotary piston member, or by contacting a first terminal end of a second arcuate ledge with the elongated vane of the second rotary piston member.

In a third aspect, a method of assembling a hydraulic rotary actuator includes providing a stator housing 1002 comprising a single seamless body as described herein having a bore disposed axially therethrough. A first rotary piston member as described herein is inserted through the first end bore portion of the housing and positioned in the middle bore portion of the housing. A second rotary piston member as described herein is inserted through either the first end bore portion or the second end bore portion of the housing and positioned in the middle bore portion of the housing with an elongated vane longitudinally adjacent to the elongated vane of the first rotary piston member. The elongated vane of the first rotary piston member and the elongated vane of the second rotary piston member is assembled to the rotor output shaft when the rotor output shaft is positioned longitudinally inside the housing. A portion of the continuous seal positioned in the seal groove along the first peripheral longitudinal face contacts the semi-cylindrical surface 1024 of the middle bore portion, a portion of the continuous seal positioned in the seal groove of the second peripheral longitudinal face contacts the semi-cylindrical surface 1026 of the arcuate ledge, a portion of the continuous seal positioned in the seal groove of the first peripheral lateral face contacts the first interior end surface, and a portion of the continuous seal positioned in the seal groove of the second peripheral face contacts the second interior end surface.

The systems and techniques described herein may provide one or more of the following advantages. In prior art designs of rotary actuators, corner seals can be a common source of fluid leakage between pressure chambers. Additionally, prior art rotary actuator housings are frequently assembled from one or more split casing segments that have seams that must be sealed. Leakage is possible from these housing seals. Cross-vane leakage can also occur in prior art rotary actuators. Leakage of hydraulic fluid in any of these manners may negatively impact performance, thermal management, pump sizing, and reliability of the hydraulic blocking rotary actuator. The details of one or more implementations are set forth in the accompanying drawings and the description below. Other features and advantages will be apparent from the description and drawings, and from the claims.

DETAILED DESCRIPTION

This document describes examples of hydraulic rotary actuators with continuous rotary piston seals. In general, by using continuous rotary piston seals between rotor assemblies and stator housings, the use of corner seals may be eliminated. Corner seals can be associated with undesirable effects, such as reduced mechanical performance, thermal management issues, increased pump size requirements, and reduced reliability.

Figure 1:
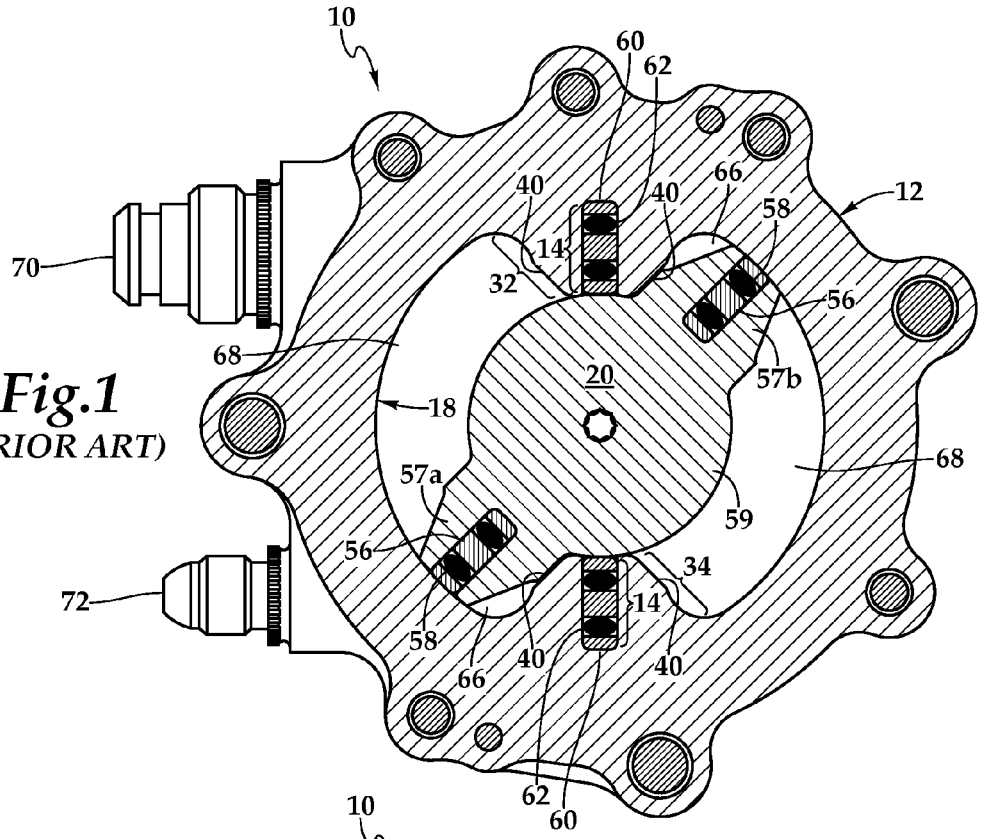
Fig.1 (PRIOR ART)
FIGS. 1 and 2 are cross-sectional views of an example of a prior art hydraulic blocking rotary actuator.
Figure 2:
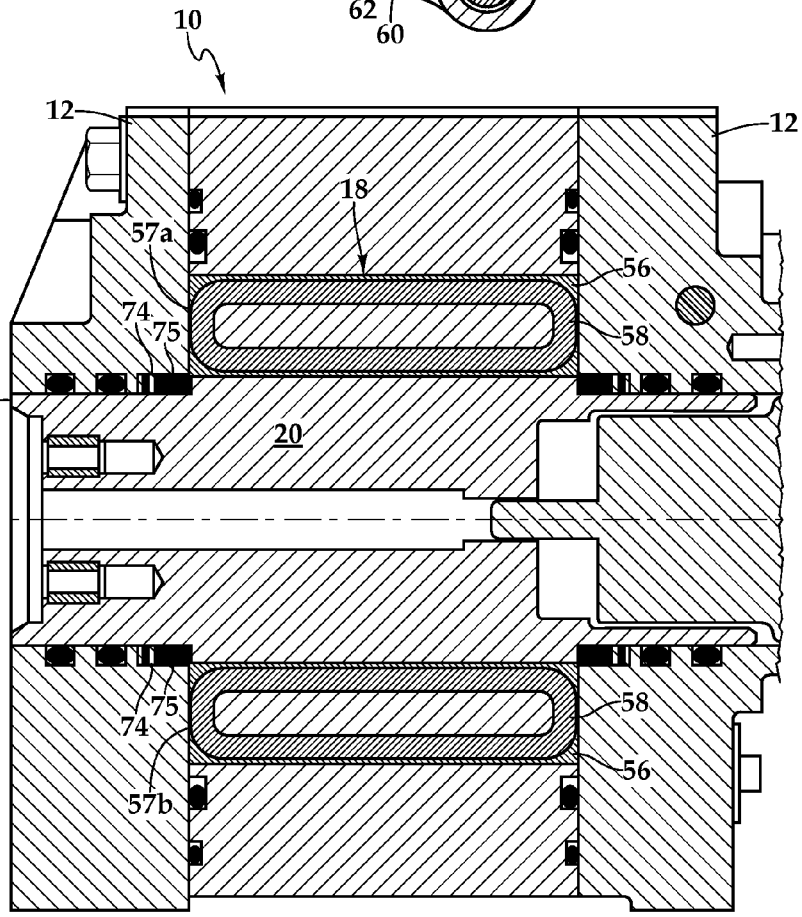
Fig.2 (PRIOR ART)

FIGS. 1 and 2 are cross-sectional views of an example of a prior art hydraulic blocking rotary actuator 10. The rotary actuator device 10 includes a stator housing assembly 12 and a sealing assembly generally indicated by the numeral 14. The details of each assembly 12 and 14 are set forth below.

The housing assembly 12 includes a cylindrical bore 18. As FIG. 1 shows, the cylindrical bore 18 is a chamber that encloses a cylindrical rotor 20. As FIG. 1 also shows, the rotor 20 is a machined cylindrical component consisting of a first rotor vane 57*a*, a second rotor vane 57*b* and a centered cylindrical hub 59. In some implementations, the diameter and linear dimensions of the first and second rotor vanes 57*a*, 57*b* are equivalent to the diameter and depth of the cylindrical bore 18.

The rotor 20 is able to rotate about 50-60 degrees in both a clockwise and counterclockwise direction relative to the stator housing assembly 12. Within the through bore 18, the stator housing 12 includes a first member 32 and a second member 34. The members 32 and 34 act as stops for the rotor 20 and prevent further rotational movement of the rotor 20. A collection of outside lateral surfaces 40 of the members 32 and 34 provide the stops for the rotor 20.

The first and second vanes 57*a* and 57*b* include a groove 56. As shown in FIG. 2, each of the grooves 56 includes one or more seals 58 configured to contact the wall of the cylindrical bore 18. The first and second members 32 and 34 include a groove 60. Each of the grooves 60 includes one or more seals 62 configured to contact the cylindrical rotor 20. The stator housing assembly 12 also includes a groove 74 that is formed to accommodate a corner seal 75.

As seen in FIG. 1, the seals 58 and 62, and the corner seal 75, define a pair of pressure chambers 66 positioned radially opposite of each other across the rotor 20, and a pair of opposing pressure chambers 68 positioned radially opposite each other across the rotor 20. In use, fluid is introduced or removed from the pressure chambers 66 through a fluid port 70, and fluid is oppositely flowed from the pressure chambers 68 through a fluid port 72.

By creating a fluid pressure differential between the pressure chambers 66 and the pressure chambers 68, the rotor 20 can be urged to rotate clockwise or counterclockwise relative to the stator housing assembly 12. In such designs, however, the corner seals 75 can be a common source of fluid leakage between the pressure chambers 66 and 68. Cross-vane leakage can also negatively impact performance, thermal management, pump sizing, and reliability of the hydraulic blocking rotary actuator 10.

Figure 3A:
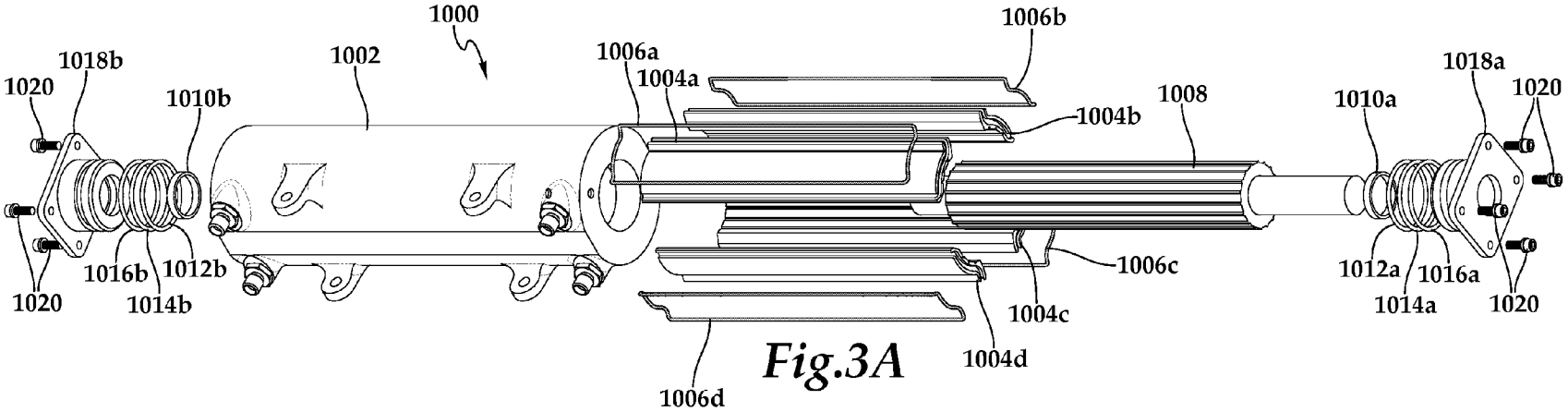
FIGS. 3A-3U are perspective and end views of a first implementation of an example rotary actuator during various stages of assembly.
Figure 3B:
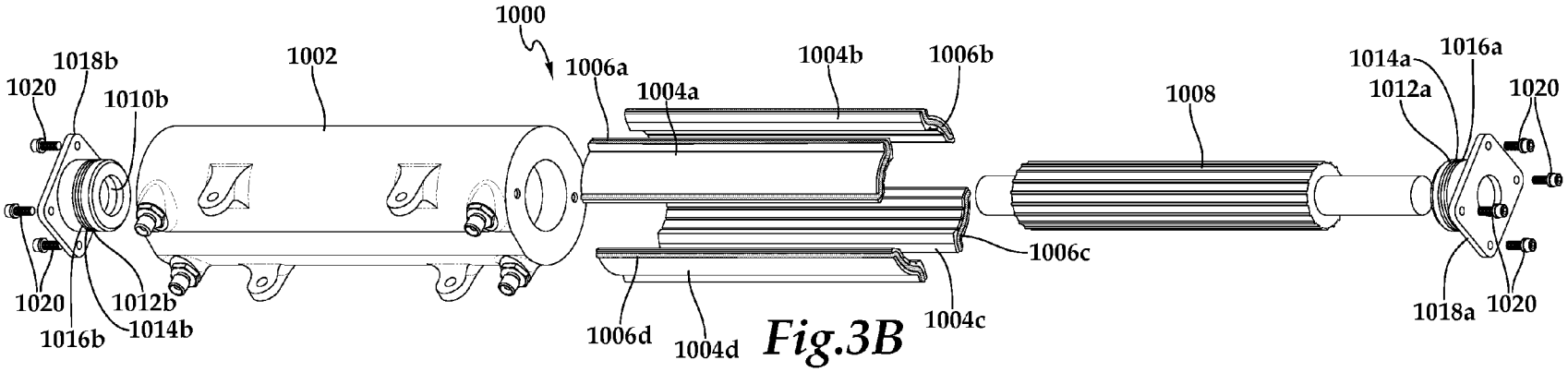
Figure 3C:
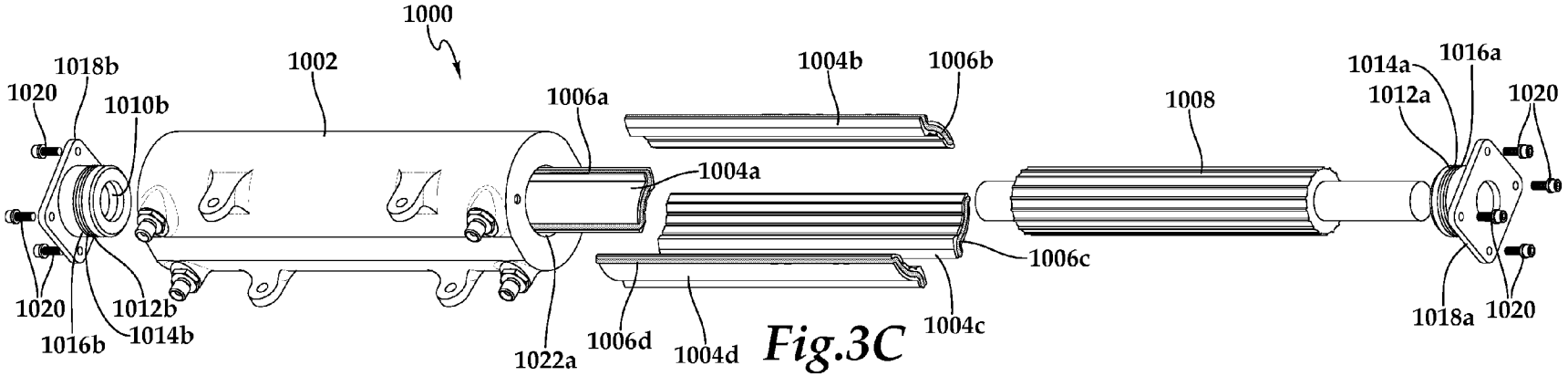
Figure 3D:
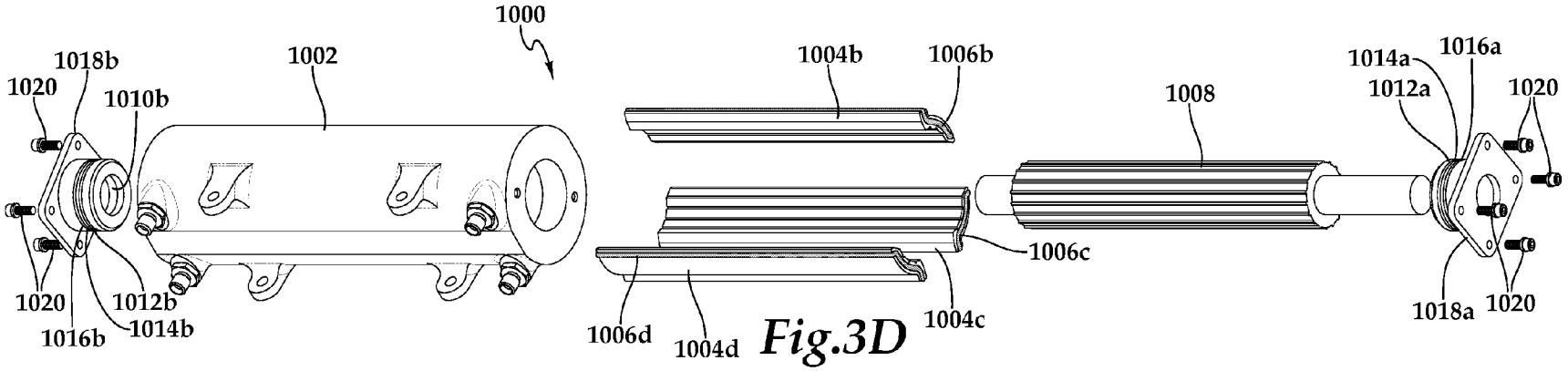
Figure 3E:
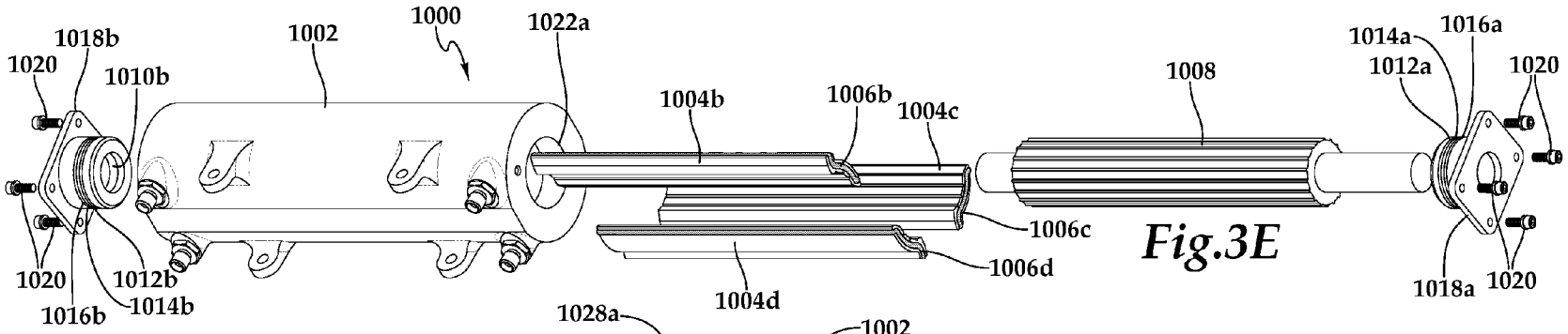
Figure 3G:
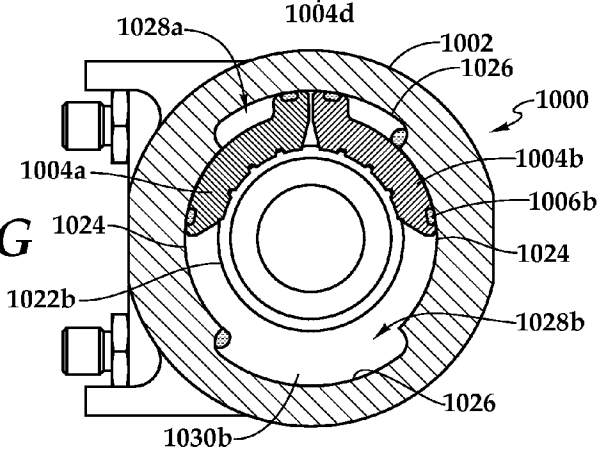
Figure 3F:
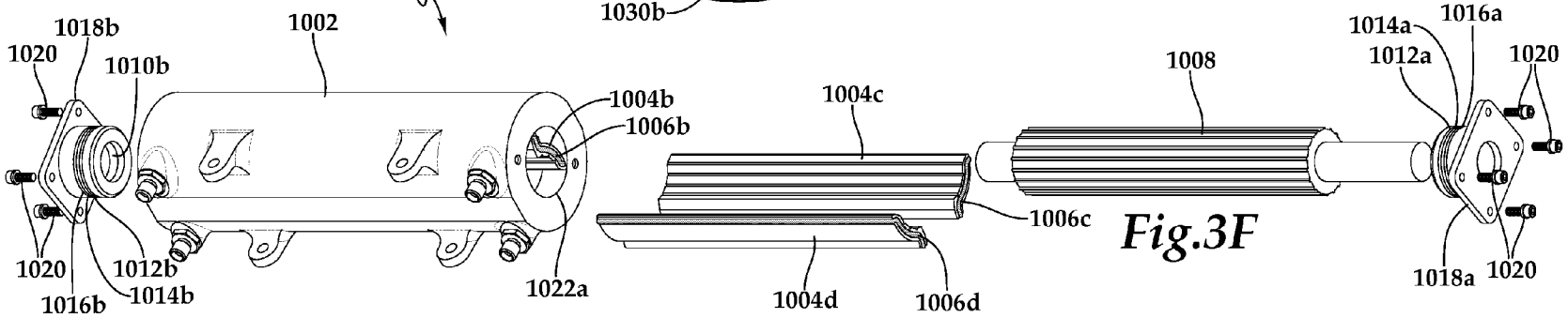
Figures 3H, 3I, 3J:
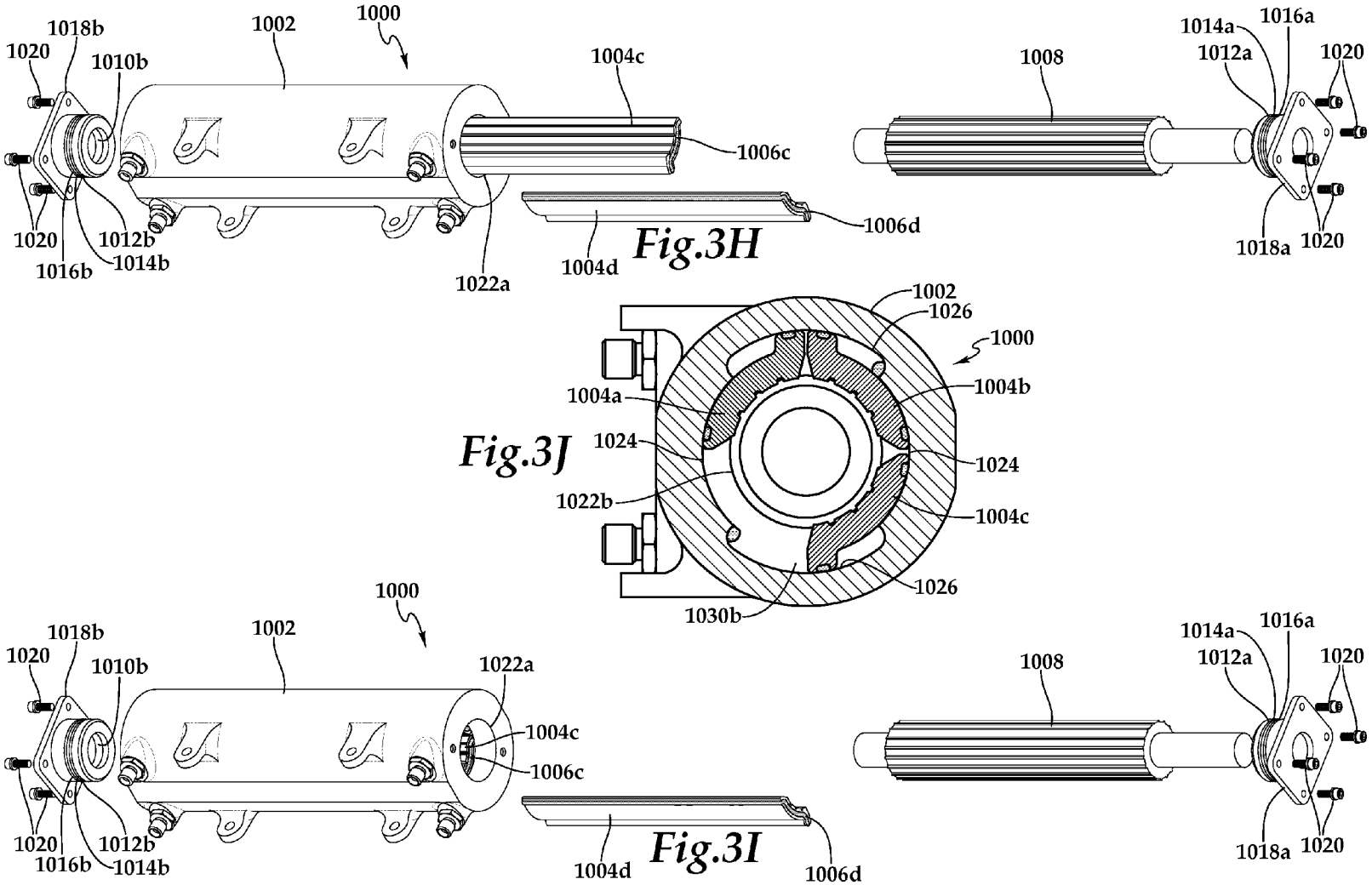
Figure 3K:
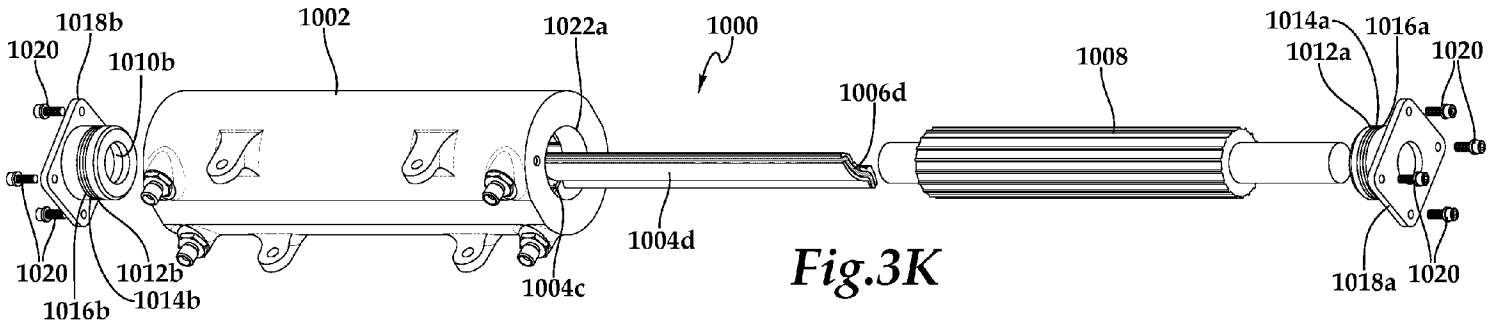
Figure 3P:
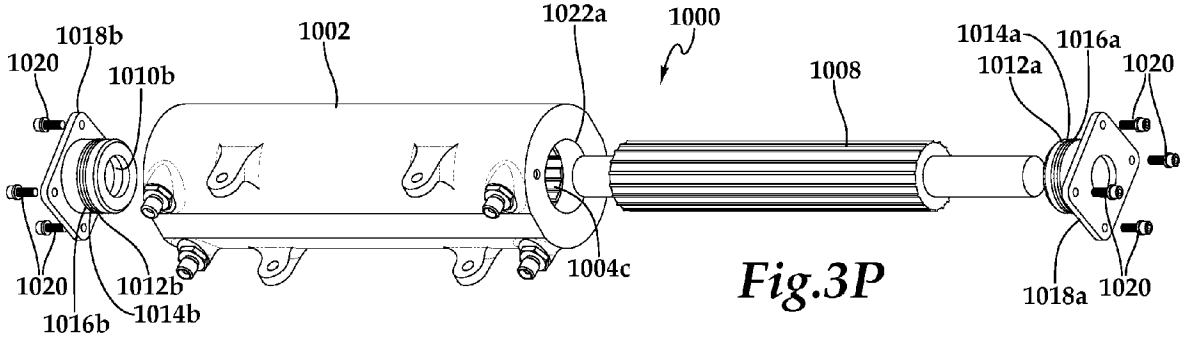
Figure 3Q:
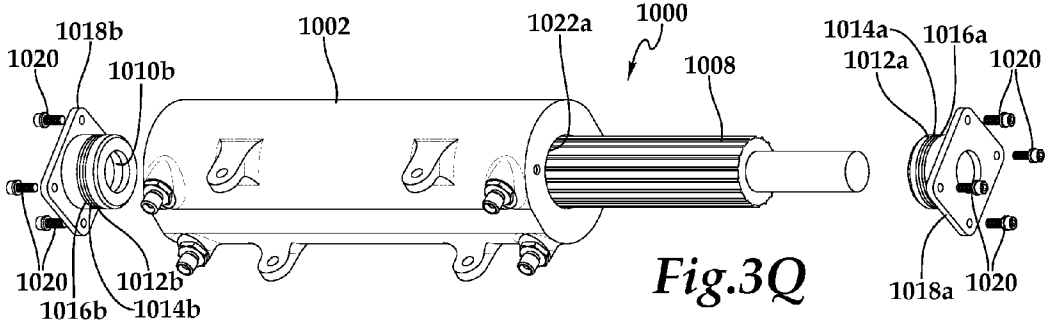
Figure 3M:
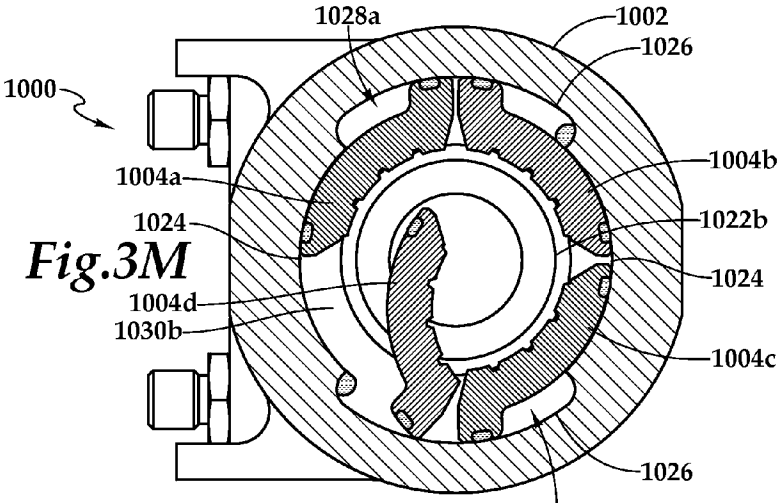
Figure 3O:
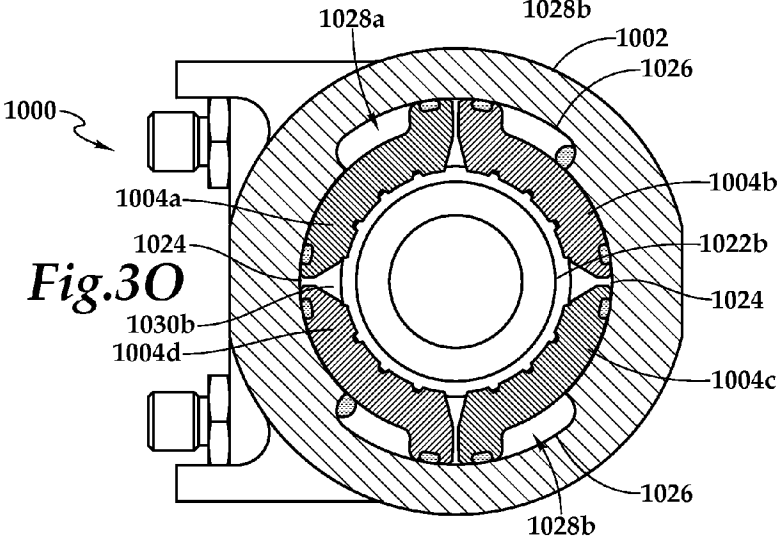
Figure 3L:
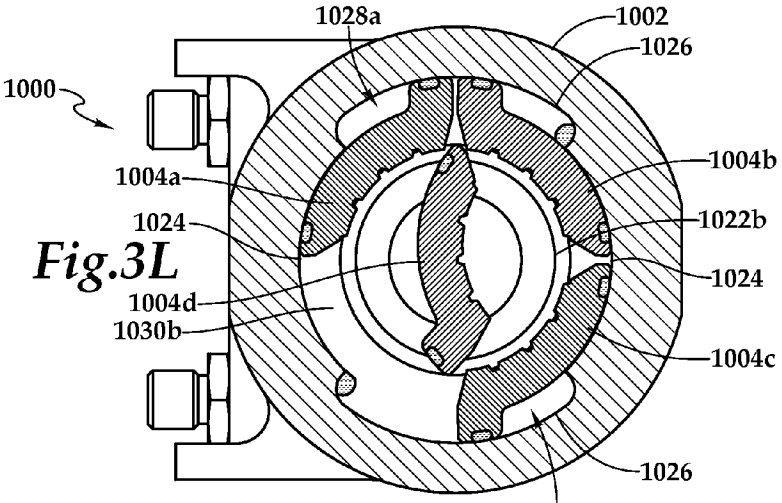
Figure 3N:
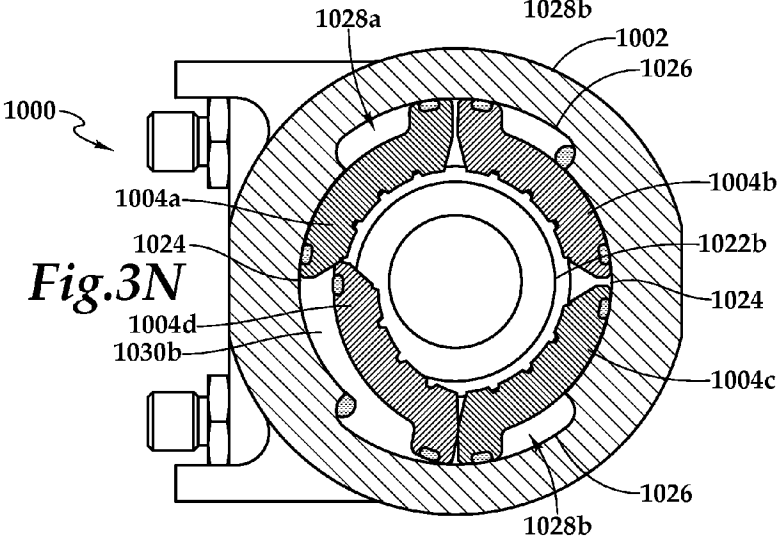
Figure 3T:
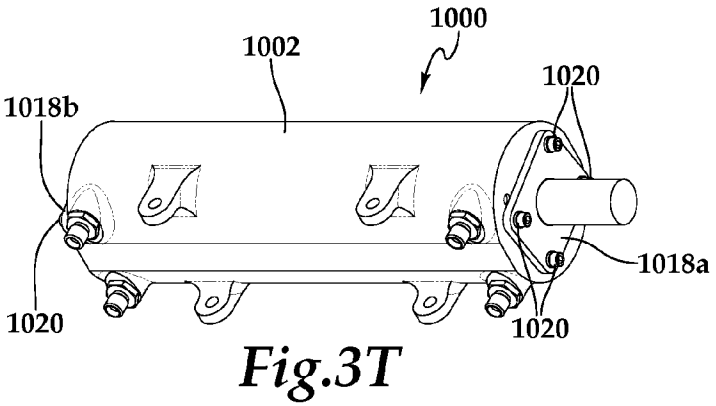
Figure 3U:
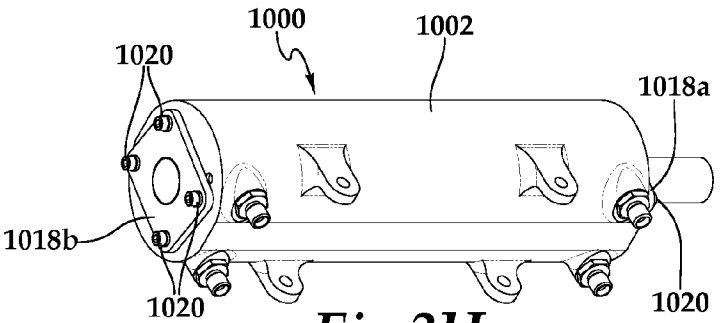

FIGS. 3A-3U are perspective and end cross-sectional views of a first implementation of an example rotary actuator 1000 during various stages of assembly. In general, rotary actuators are desirable because they can apply hydraulic power directly to a control surface through a hinge line arrangement that can maintain substantially constant torque and can conserve space; however, many rotary actuators have pressure chambers created by assembling two or more sections to form an exterior casing (housing) with an interior pressure chamber. Linear actuators are desirable because they may have an exterior casing (housing) formed from a single member thereby having a seamless pressure chamber which can minimize leakage. This seamless pressure chamber can increase hydraulic power efficiency and can provide a capability to maintain position by blocking the hydraulic fluid source. Linear actuators, however, require a crank lever attached to the hinge line of a control surface to convert linear motion to rotary motion. Hydraulic power efficiency is compromised in this arrangement because output torque changes as a function of the sine of the angle of rotation. The centerlines of linear actuators are generally packaged perpendicular to such hinge lines. Linear actuators also generally require some means to attach to crank levers, which generally means that their application uses more space than a comparable rotary actuator.

In general, the actuator 1000 with a seamless casing provides the sealing capability generally associated with linear actuators with the general mechanical configuration of rotary actuators. The geometries of the components of the rotary actuator 1000 can be used to create various rotary actuators with the sealing capabilities generally associated with linear actuators. The design of the actuator 1000 implements a continuous seal that rides between two continuous and seamless surfaces. In general, this seamless casing allows for the construction of a rotary actuator in which hydraulic ports can be blocked to substantially lock and hold a selected position. Constant output torque can be generated by the application of hydraulic pressure to the axially perpendicular face of the rotary piston.

Referring to FIG. 3A, the actuator 1000 is shown in an exploded, unassembled view. The actuator 1000 includes a housing 1002, a collection of rotary pistons 1004*a*-1004*d*, a collection of continuous seals 1006*a*-1006*d*, and a rotor 1008. In some embodiments, the length and diameter of the rotary actuator 1000 can be sized by the output load desired from the actuator 1000. While the actuator 1000 is illustrated in this example with four rotary pistons 1004*a*-1004*d*, in some embodiments load output can also be adjusted through the use of any other appropriate number of rotary pistons about the axis of the rotor 1008. The actuator 1000 also includes a pair of rotary bushings 1010*a*-1010*b*, pairs of rotary seals 1012*a*-1012*b*, 1014*a*-1014*b*, and 1016*a*-1016*b*, a pair of end assemblies 1018*a*-1018*b*, and a collection of fasteners 1020.

In general, the actuator 1000 includes the collection of rotary pistons 1004*a*-1004*d* which translates rotary motion to the rotor 1008 by reacting to fluid pressure provided between the rotary pistons 1004*a*-1004*d* and housing 1002. The rotary pistons 1004*a*-1004*d* are separate pieces to allow for assembly into the housing 1002. Each of the rotary pistons 1004*a*-1004*d* uses a corresponding one of the continuous seals 1006*a*-1006*d* that rides uninterrupted on the inside of a pocket in the housing 1002. In some implementations, the seals 1006*a*-1006*d* can be O-rings, X-rings, Q-rings, D-rings, energized seals, or combinations of these and/or any other appropriate form of seals. The rotary pistons 1004*a*-1004*d* are keyed to the rotor 1008 to allow for proper spacing and to transmit the load from the rotary pistons 1004*a*-1004*d* to the rotor 1008. Radial forces resulting from operating pressure acting on the rotary pistons 1004*a*-1004*d* work to seat the rotary pistons 1004*a*-1004*d* against the rotor 1008 to maintain relative position. When installed, all rotary pistons 1004*a*-1004*d* rotate about the same axis, making them all substantially concentric to each other.

Referring now to FIG. 3B, the actuator 1000 is shown with the rotary seals 1012*a*-1012*b*, 1014*a*-1014*b*, 1016*a*-1016*b*, and the bushings 1010*a*-1010*b* assembled with their respective end assemblies 1018*a*-1018*b*. FIG. 3B also shows the actuator 1000 with the continuous seals 1006*a*-1006*d* assembled with their corresponding rotary pistons 1004*a*-1004*d*. Each of the rotary pistons 1004*a*-1004*d* includes a continuous seal groove about its periphery. As will be discussed in the description of subsequent assembly stages, the geometry of the continuous seal grooves and the assembled positions of the rotary pistons 1004*a*-1004*d* bring the continuous seals into contact with the inner surfaces of the housing 1002.

FIG. 3C shows the actuator 1000 with the rotary piston 1004*a* partially inserted into the housing 1002 though an opening 1022*a* formed in a first end of the housing 1002. FIG. 3D shows the actuator 1000 with the rotary piston 1004*a* fully inserted into the housing 1002.

Referring now to FIG. 3E, the actuator 1000 is shown with the rotary piston 1004*b* oriented in preparation for insertion into the housing 1002 through the opening 1022*a*, and FIG. 3F shows the actuator 1000 with the rotary piston 1004*b* fully inserted into the housing 1002, still in the orientation shown in FIG. 3E.

FIG. 3G is a cross-sectional view of the housing 1002 and the rotary pistons 1004*a* and 1004*b*. The illustrated view reveals that housing includes first semi-cylindrical surface 1024 and a second semi-cylindrical surface 1026. The surfaces 1024 and 1026 are oriented along the axis of the housing 1002. The second surface 1026 is formed with a diameter larger than that of the first surface 1024, both of which have diameters larger than that of the opening 1022*a* and an opening 1022*b* formed in a second end of the housing 1002. The differences in the diameters of the first and second surfaces 1024 and 1026 provides two pressure cavities 1028*a* and 1028*b* within the housing 1002.

In general, the assembly of the rotary pistons 1004*a*-1004*d* with the housing 1002 involves orienting one of the rotary pistons, such as the rotary piston 1004*b* such that it will pass from outside of the housing 1002, through one of the openings 1022*a*-1022*b*, to the interior of the housing 1002. Once the rotary piston 1004*b* is fully inserted into the housing 1002, the rotary piston 1004 can be rotated within the interior space formed by the first surface 1024 and the pressure cavities 1028*a*-1028*b*. By positioning the rotary piston 1004*b* in the position illustrated in FIG. 3G, the continuous seal 1006*b* is brought into seamless, sealing contact with the first surface 1024, the second surface 1026, an interior end surface 1030B, and an opposing interior end surface 1030*a* (not shown in the cross-section of FIG. 3G). In some embodiments, the use of the continuous seals 1006*a*-1006*d* in seamless contact with a surface such as the interior surfaces 1024, 1026, 1030*a* and 1030*b*, can substantially eliminate the leakage generally associated with casings (housings) for some rotary actuators while also providing the mechanical integrity and blocking capabilities generally associated with linear actuators.

Referring now to FIG. 3H, the actuator 1000 is shown with the rotary piston 1004*c* oriented in preparation for insertion into the housing 1002 through the opening 1022*a*, and FIG. 3I shows the actuator 1000 with the rotary piston 1004*c* fully inserted into the housing 1002, still in the orientation shown in FIG. 3H.

FIG. 3J is a cross-sectional view of the housing 1002 and the rotary pistons 1004*a*-1004*c*. In the illustrated example, the rotary piston 1004*c* is shown substantially in its assembled position, having been inserted through the opening 1022*a* and re-oriented once inside the housing 1002 to bring the continuous seal 1006*c* into seamless, sealing contact with the first surface 1024, the second surface 1026, the interior end surface 1030*b*, and an opposing interior end surface 1030*a* (not shown).

Referring now to FIG. 3K, the actuator 1000 is shown with the rotary piston 1004*d* oriented in preparation for insertion into the housing 1002 through the opening 1022*a*.

FIGS. 3L-3O are cross-sectional views of the housing 1002 and the rotary pistons 1004*a*-1004*d* that illustrate four example stages in the assembly of the rotary piston 1004*d* into the housing 1002. Although FIGS. 3L-3O illustrate the assembly of the rotary piston 1004*d*, the assembly of the other rotary pistons 1004*a*-1004*c* can be performed in a similar manner. In FIG. 3L, the rotary piston 1004*d* is shown in the position and orientation shown in FIG. 3K, having been inserted through the opening 1022*a*. Referring now to FIG. 3M, once the rotary piston 1004*d* is fully within the interior of the housing 1002, the rotary piston 1004*d* is shifted linearly perpendicular to the axis of the rotary piston 1004*d* and the housing 1002 to partly occupy the pressure chamber 1028*b* and contact the second surface 1026 of the pressure chamber 1028*b*.

Referring now to FIG. 3N, the rotary piston 1004*d* is shown partly rotated counterclockwise from the position shown in FIG. 3M. The rotary piston 1004*d* is rotated substantially about the point where the rotary piston 1004*d* contacts the second surface 1026 of the pressure chamber 1028*b*. Such positioning and rotation provide sufficient space to allow the rotary piston 1004*d* to pivot past the rotary piston 1004*a* without interference, and result in the configuration shown in FIG. 3O.

FIG. 3O shows the actuator 1000 with the rotary pistons 1004*a*-1004*d* in their assembled configuration. In the illustrated configuration, the rotary piston 1004*d* has been further rotated counterclockwise inside the housing 1002 to bring the continuous seal 1006*d* into seamless, sealing contact with the first surface 1024, the second surface 1026, the interior end surface 1030*b*, and an opposing interior end surface 1030*a* (not shown). The configuration and dimensions of the housing 1002, the openings 1022*a*-1022*b*, the rotary pistons 1004*a*-1004*d*, the first surface 1024, the second surface 1026, and the pressure chambers 1028*a*-1028*b*, permit assembly of the rotary pistons 1004*a*-1004*d* into the housing 1002 through the openings 1022*a* and/or 1022*b*. Such assembly provides a seamless surface against which the continuous seals 1006*a*-1006*d* can rest as depicted by FIG. 3O.

FIG. 3P shows actuator 1000 with the housing 1002 and the rotary pistons 1004*a*-1004*d* assembled as depicted in FIG. 3O (partly shown in FIG. 3P), and the rotor 1008 positioned for assembly into the housing 1002. FIG. 3Q shows the rotor 1008 partly assembled with the housing 1002 and the rotary pistons 1004*a*-1004*d* (not shown). The rotor 1008 is passed through the opening 1022*a* to assemble the rotor 1008 with the rotary pistons 1004*a*-1004*d*, as will be described in further detail in the descriptions of FIGS. 4A-4D.

Figure 3R:
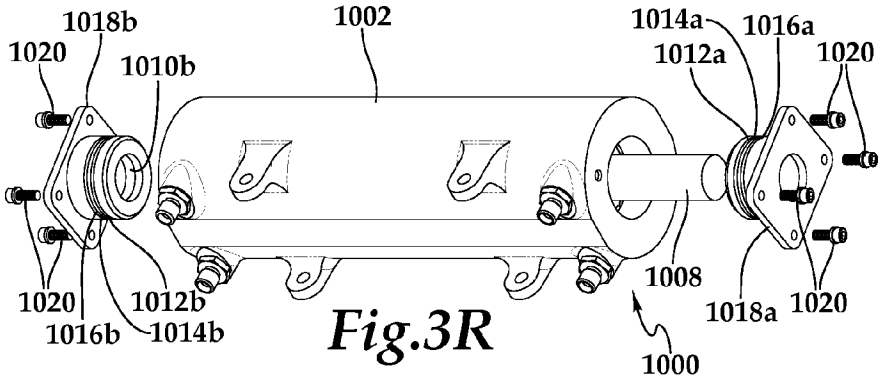
Figure 3S:
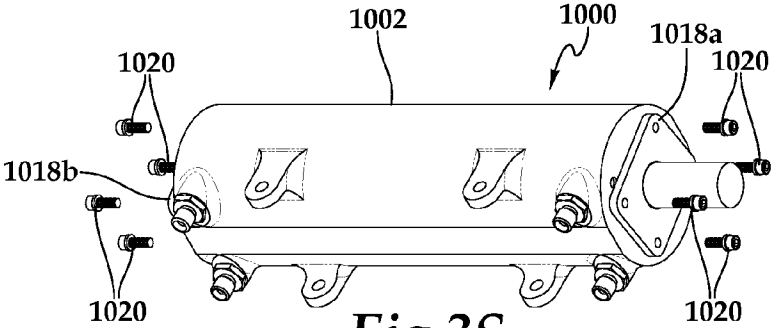

FIG. 3R shows the actuator 1000 with the rotor 1008 assembled into the housing 1002, and with the end assemblies 1018*a*-1018*b* in position for assembly with the housing 1002. FIG. 3S shows the actuator 1000 with the end assembly 1018*a* assembled with the housing 1002. Assembly 1018*b* is similarly assembled to the opposite end of the housing 1002. FIG. 3T shows the actuator 1000 with the end assembly 1018*a* fastened to the housing by the fasteners 1020. FIG. 3U is another perspective view of the actuator 1000, in which the end assembly 1018*b* is shown assembled and fastened to the housing 1002 by the fasteners 1020.

Figure 4A:
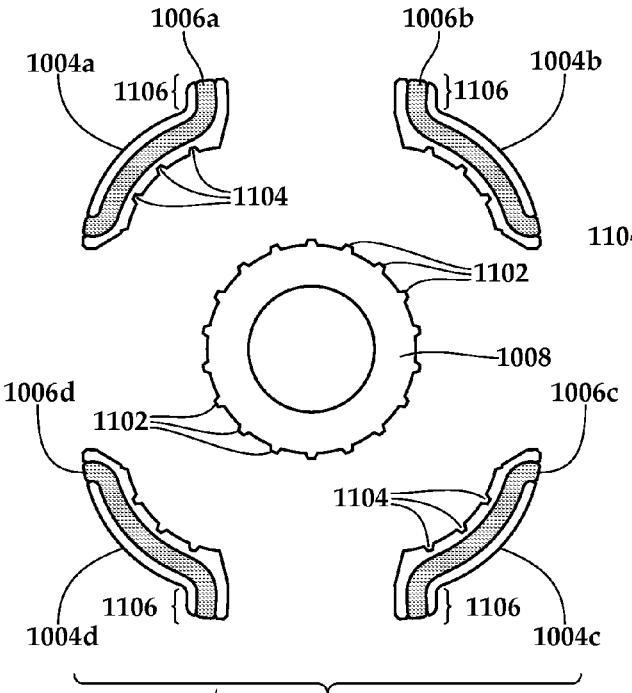
FIGS. 4A-4D are exploded and assembled perspective and end views of rotary pistons and a rotor of the first example rotary actuator.
Figure 4B:
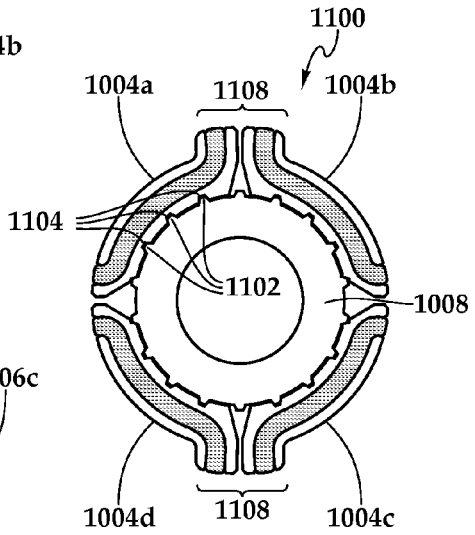
Figure 4C:
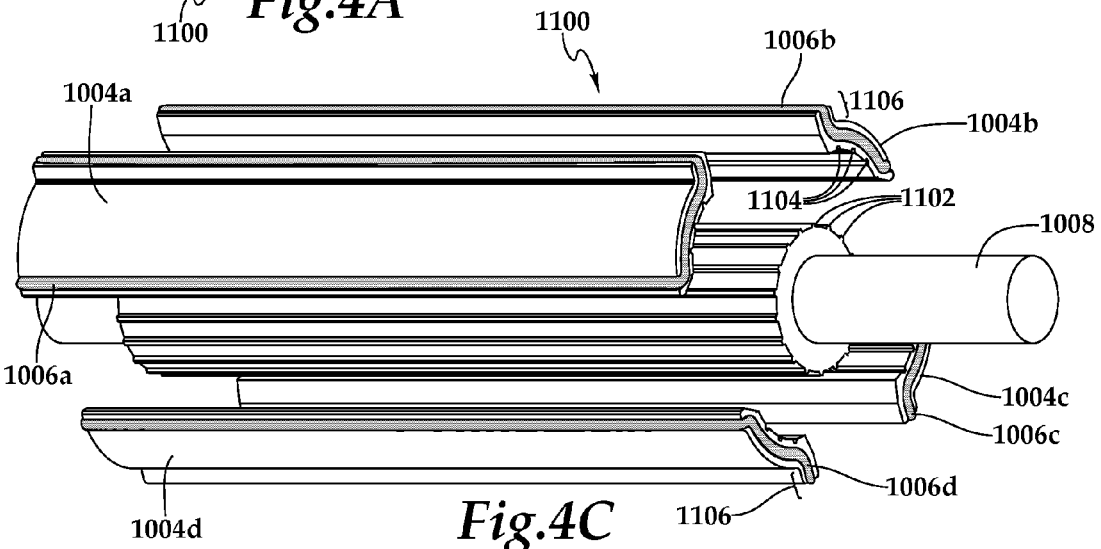
Figure 4D:
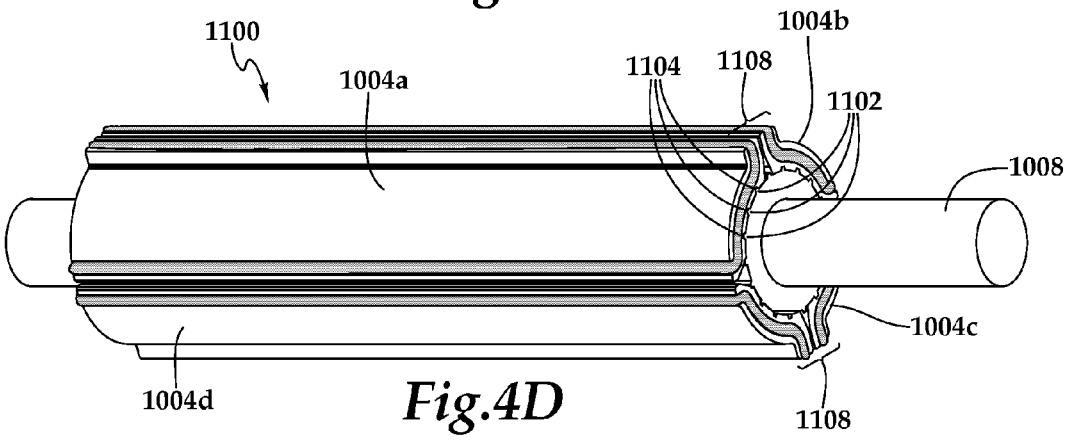

FIGS. 4A-4D are exploded and assembled perspective and end views of a rotor assembly 1100. The rotor assembly includes the rotary pistons 1004*a*-1004*d* and the rotor 1008. Referring now to FIGS. 4A and 4C wherein the rotary pistons 1004*a*-1004*d* are illustrated in exploded views. The rotor 1008 includes a collection of gear teeth 1102, arranged radially about the axis of the rotor 1008 and extending along the length of the rotor 1008. The rotary pistons 1004*a*-1004*d* include collections of slots 1104 formed to accept the teeth 1102 when the rotor 1008 is assembled with the rotary pistons 1004*a*-1004*d* as illustrated in FIGS. 4B and 4D.

FIGS. 4B and 4D show the rotary pistons 1004*a*-1004*d* and the rotor 1008 of the rotor assembly 1100 in assembled views. The assembled configuration of the rotor assembly 1100, the rotary pistons 1004*a*-1004*d* (e.g., the configuration as shown in FIG. 3O) form a substantially orbital arrangement of the grooves 1104. The slots 1104 are configured to slidably accept the teeth 1102 of the rotor 1008 during assembly (e.g., FIG. 3Q). Such a configuration thereby allows assembly of the rotor 1008 with the rotary pistons 1004*a*-1004*d* through the opening 1022*a* or 1022*b*.

The rotary pistons 1004*a*-1004*d* each include an elongated vane 1106. The elongated vanes 1106 are configured to extend from the rotary pistons 1004*a*-1004*d*, substantially at the diameter of the first surface 1024, to the second surface 1026. As such, the elongated vanes 1106 extend into the pressure chambers 1028*a*-1028*b*, bringing the continuous seals 1006*a*-1006*d* into sealing contact with the second surfaces 1026.

The elongated vanes 1106 are assembled in a back-to-back configuration, in which adjacent pairs of the elongated vanes form a pair of opposing rotary piston assemblies 1108. In the assembled configuration, the teeth 1102 of the rotor 1008 engage the slots 1104 of the rotary pistons 1004*a*-1004*d*, such that fluidic (e.g., hydraulic) forces applied to the rotary pistons 1004*a*-1004*d* can be transferred to the rotor 1008 and cause the rotor to rotate.

Figure 5A:
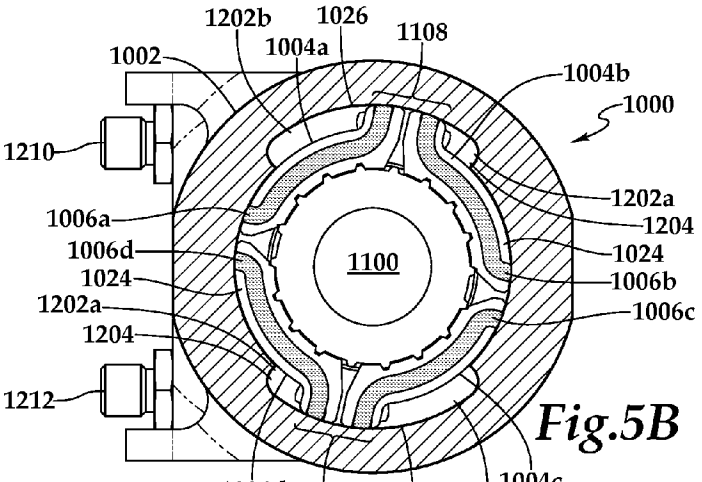
FIGS. 5A-5D are cross-sectional views of the first example rotary actuator in various operational positions.

FIGS. 5A-5D are cross-sectional views of the example rotary actuator 1000 with the rotor assembly 1100 in various operational positions. Referring to FIG. 5A, the actuator 1000 is shown with the rotor assembly 1100 in a fully clockwise position relative to the housing 1002. The pair of opposing rotary piston assemblies 1108 is disposed radially about the rotor 1008.

The continuous seals 1006*a*-1006*d* contact the second surfaces 1026 within the pressure chambers 1028*a* and 1028*b* and the first surfaces 1024 to form a pair of sealed, seamless opposing pressure chambers 1202*a*, and a pair of sealed, seamless opposing pressure chambers 1202*b*. In some implementations, opposing pressure chambers can be in fluid communication to balance the fluid pressures in opposing pairs of pressure chambers. In some implementations, the opposing pressure chambers can have equal surface areas as the rotor 1008 rotates within the housing 1002.

The opposing pressure chambers 1202*a* and 1202*b* defined by the stator housing assembly 1002 and the rotor assembly 1100 have substantially equal surface areas as the rotor assembly 1100 rotates within the housing 1002. In some implementations, such a configuration of equal opposing chambers supplies balanced torque to the rotor assembly 1100.

In the configuration illustrated in FIG. 5A, the rotor assembly 1100 is in a fully clockwise position, in which the rotary piston assemblies 1108 are in contact with hard stops 1204 formed at the junctions of the first and second surfaces 1024 and 1026. A pressurized fluid (e.g., hydraulic fluid) can be applied to a fluid port 1210 that is in fluid communication with the pressure chambers 1202*a*. Similarly, the pressurized fluid can be applied to a fluid port 1212 that is in fluid communication with the pressure chambers 1202*b*. In some implementations the opposing pressure chambers 1202*a* can be adapted to be connected to an external pressure source through the fluid port 1210, and the opposing pressure chambers 1202*b* can be adapted to be connected to a second external pressure source through the fluid port 1212. In some implementations, the first external pressure source can provide a rotational fluid (e.g., hydraulic fluid) at a first pressure for contacting a first pair of sides of the rotary piston assemblies 1108 and the second external pressure source can provide a rotational fluid for contacting a second pair of sides of the rotary piston assemblies 1108.

Figure 5B:
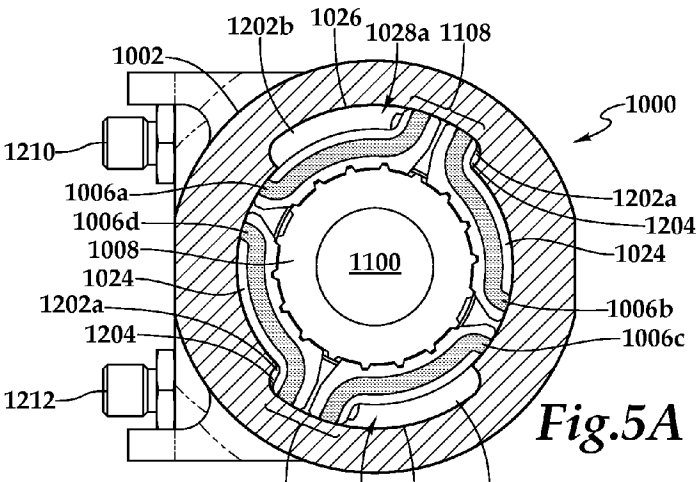

Referring now to FIG. 5B, as the fluid is applied through the fluid port 1210 the rotor assembly 1100 is urged counterclockwise relative to the housing 1002. As the rotor assembly 1100 rotates, the rotary piston assemblies 1108 sweep the continuous seals 1006*a*-1006*d* along the second surfaces 1026 while the rotary pistons 1004*a*-1004*d* sweep the continuous seals 1006*a*-1006*d* along the first surfaces 1024. Fluid in the pressure chambers 1202*b*, displaced by the rotation of the rotor assembly 1100, flows out through fluid ports (not shown) in fluid communication with a fluid port 1212.

Figure 5C:
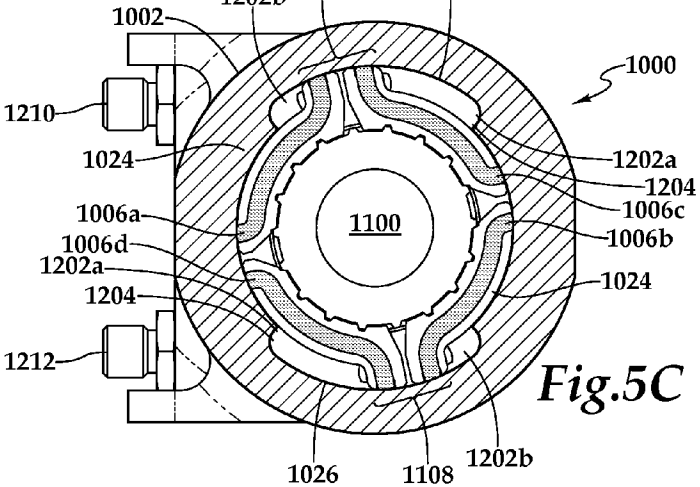
Figure 5D:
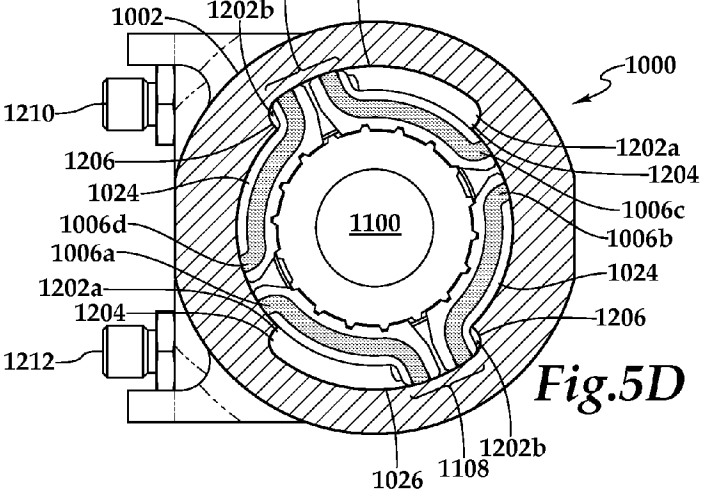

Referring now to FIG. 5C, as the fluid further fills the pressure chambers 1202*a*, the rotor assembly 1100 continues to rotate counterclockwise. Eventually, as depicted in FIG. 5D, the rotor assembly 1100 can reach a terminal counterclockwise position relative to the housing 1002. Counterclockwise rotation of the rotor assembly 1100 stops when the rotary piston assemblies 1108 contact hard stops 1206 formed at the junctions of the first and second surfaces 1024 and 1026.

Figure 6:
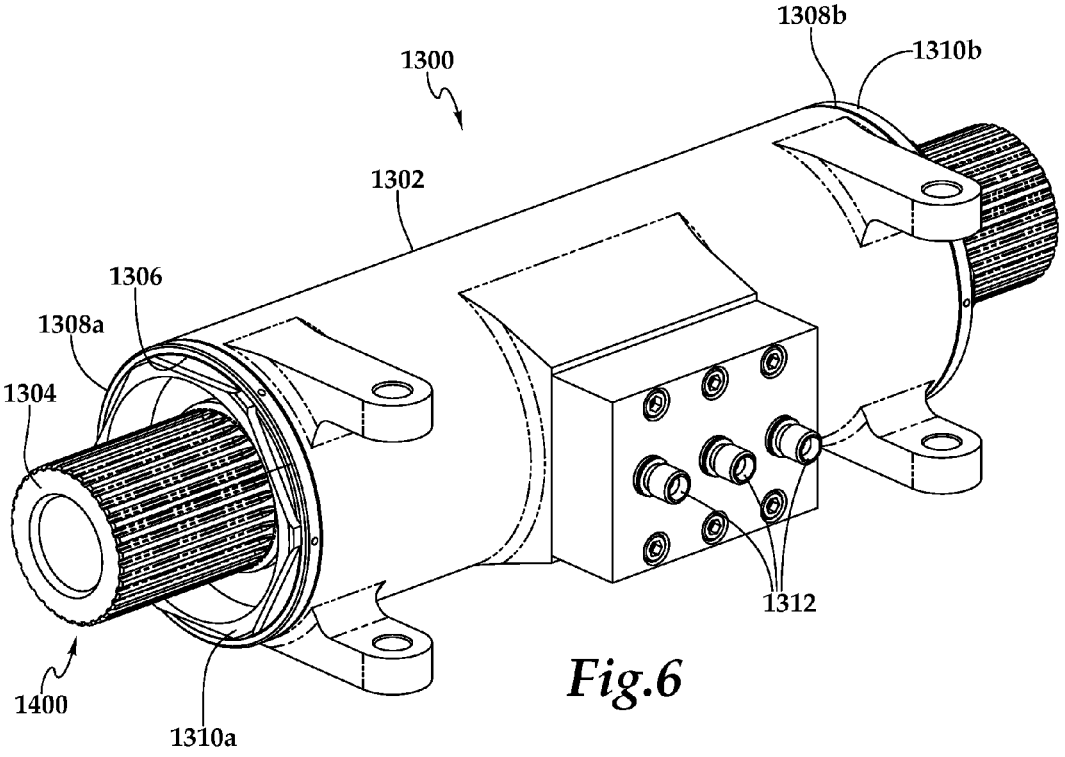
FIG. 6 is a perspective view of a second example rotary actuator.

FIG. 6 is a perspective view of a second example rotary actuator 1300. The rotary actuator 1300 includes a stator housing 1302, a rotor 1304, and static rotary piston assemblies (not visible in this view). The configurations of the rotor 1304 and the static rotary piston assemblies are discussed further in the descriptions of FIGS. 7-10.

The stator housing 1302 is generally formed as a cylinder with a central bore 1306. The rotor 1304 and the static rotary piston assemblies are assembled as an insert assembly 1400 which is then assembled with the stator housing 1302 by inserting the insert assembly 1400 into the through bore 1306 from a stator housing end 1308*a* or a stator housing end 1308*b*. The insert assembly 1400 is secured within the stator housing 1302 by assembling bushing assemblies 1310*a* and 1310*b* to the stator housing 1302. In the illustrated example, the bushing assemblies 1310*a*, 1310*b* include screw threads (not shown) that mate with screw threads (not shown) formed in the through bore 1306 to threadably receive the bushing assemblies 1310*a*, 1310*b*.

The stator housing 1302 also includes a collection of fluid ports 1312. The fluid ports 1312 are in fluid connection with fluid passages (not shown) formed through the body of the stator housing 1302. The fluid passages are discussed in the descriptions of FIGS. 11A-11C.

Figure 7:
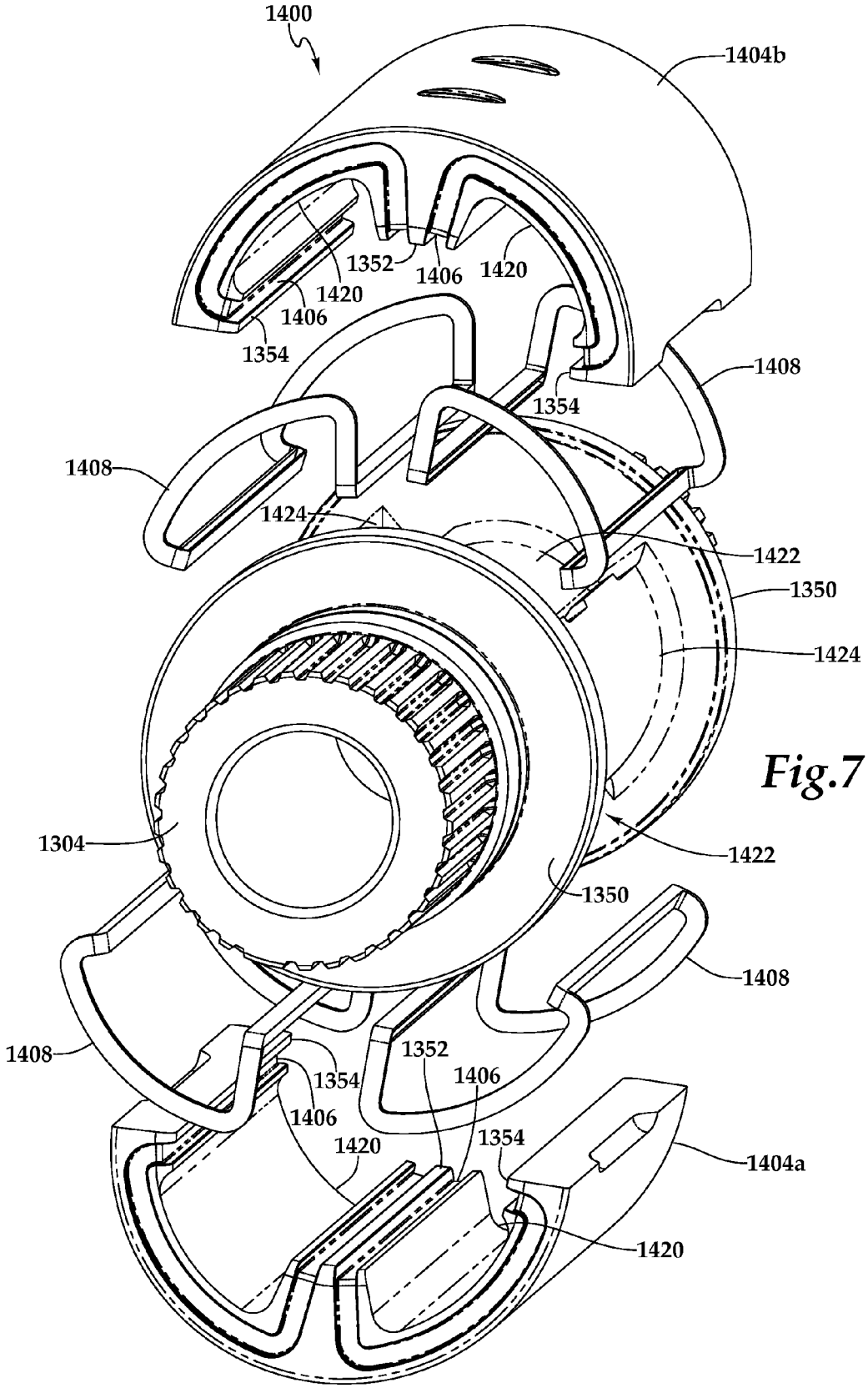
FIG. 7 is an exploded view of a rotary actuator insert assembly of the second example rotary actuator.

FIG. 7 is an exploded view of an example rotary actuator insert assembly 1400. In general, the insert assembly 1400 includes the rotor 1304 and static rotary piston 1404*a*, 1404*b* discussed in the description of FIG. 6 as being inserted into the through bore 1306 of the stator housing 1302 and secured by the bushing assemblies 1310*a*, 1310*b*.

The insert assembly 1400 includes the rotor 1304, a static piston 1404*a*, and a static piston 1404*b*. The rotor 1304 includes end sections 1350, a first diameter 1422, and a second diameter 1424. The end sections 1350 are formed about the axis of the rotor 1304 with a diameter substantially similar to, but smaller than, that of the through bore 1306. The second diameter 1424 is formed about the axis of the rotor 1304 with a radial diameter smaller than that of the end sections 1350. The first diameter 1422 is formed about the axis of the rotor 1304 as a pair of substantially quarter sector recesses, in which the radial diameter of the first diameter 1422 is smaller than that of the second diameter 1424.

The static pistons 1404*a*, 1404*b* each include two continuous seal grooves 1406 which receive continuous seals 1408. The static pistons 1404*a*, 1404*b* are formed as substantially half-sector in the illustrated example, with an outside diameter approximately that of the bore 1306 such that the static pistons 1404*a*, 1404*b* will substantially occupy the space within the bore 1306 when assembled. The axial lengths of the static pistons 1404*a*, 1404*b* are selected such that the static pistons 1404*a*, 1404*b* will substantially fill the axial length of the rotor 1304 between the end sections 1350 and cause sections of the continuous seals 1408, resting in the continuous seal grooves 1406, to be in sealing contact with the interior surfaces of the end sections 1350.

The static pistons 1404*a*, 1404*b* each include five primary interior surfaces; two interior walls 1420, an inner vane 1352, and two outer vanes 1354. The interior walls 1420 form an inner cylindrical surface which is concentric to the outer cylindrical surfaces of the static pistons 1404*a*, 1404*b*. Each interior wall 1420 is interrupted by the inner vane 1352 which extends radially inward perpendicular to the interior wall 1420. The interior walls 1420 are terminated at their semi-cylindrical ends by the outer vanes 1354, which extend radially inward perpendicular to the interior wall 1420.

The inner vane 1352 extends an inward distance from the interior wall 1420 such that sections of the continuous seals 1408, resting in the continuous seal grooves 1406, will be brought into sealing contact with the first diameter 1422 of the rotor 1304. The outer vanes 1354 extend an inward distance from the interior wall 1420 such that sections of the continuous seals 1408, resting in the continuous seal grooves 1406, will be brought into sealing contact with the second diameter 1424 of the rotor 1304. A portion of the continuous seals 1408 disposed in the continuous seal grooves 1406 on the lateral face of static pistons 1404*a*, 1404*b* are in sealing contact with interior lateral surfaces of the end sections 1350. When assembled, the rotor 1304, the static pistons 1404*a*, 1404*b*, and the continuous seals 1408 form four fluid pressure chambers. In some implementations, opposing pairs of fluid chambers can have equal surface areas as the rotor 1304 rotates within the housing 1302. In some implementations, an opposing pair of the fluid chambers can be adapted to be connected to an external pressure source and a second opposing pair of the fluid chambers can be adapted to be connected to a second external pressure source. These chambers are described further in the description of FIG. 10.

Figure 8:
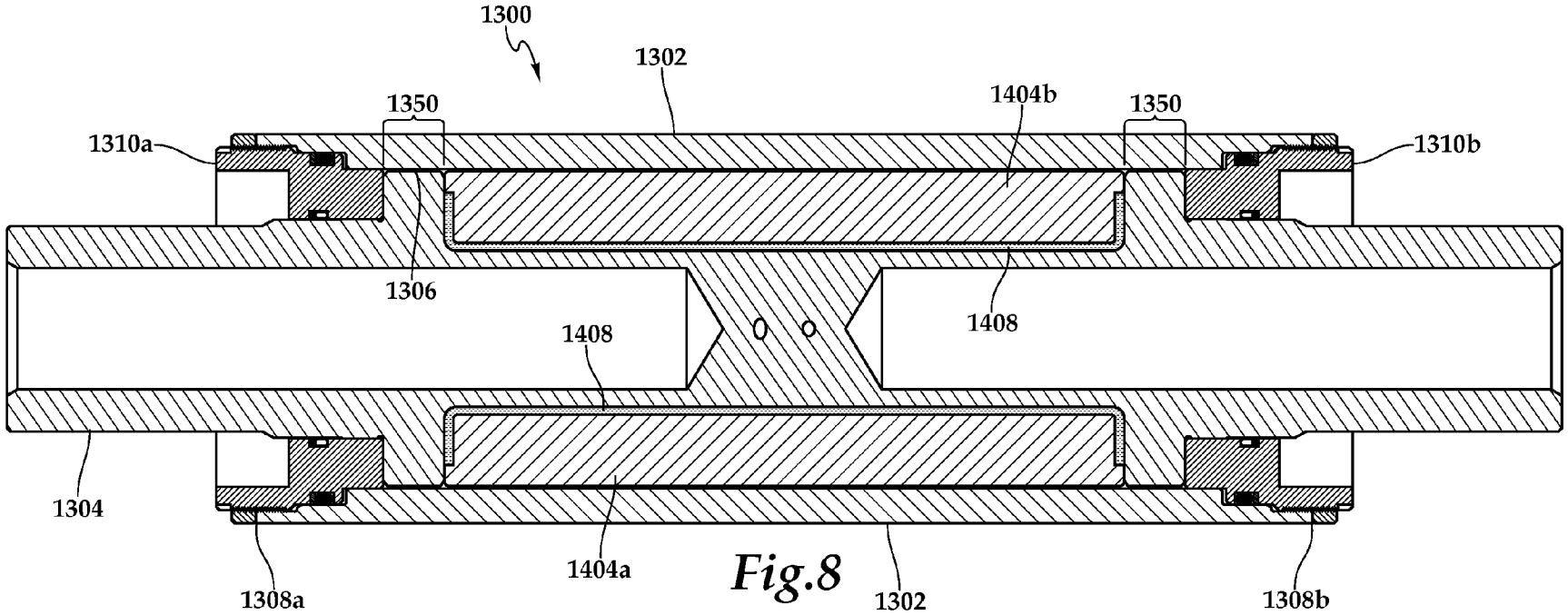
FIG. 8 is a side cross-sectional view of the second example rotary actuator.

FIG. 8 is a side cross-sectional view of the example rotary actuator 1300. In this view, the rotor 1304 and the static pistons 1404*a*, 1404*b* are shown assembled with the housing 1302. In general, the continuous seals 1408 are placed in the continuous seal grooves 1406, and the static pistons 1404*a*, 1404*b* are assembled into the rotor 1304 between the end sections 1350. The assemblage of the static pistons 1404*a*, 1404*b* and the rotor 1304 is then inserted into the housing 1302 through one of the housing ends 1308*a*, 1308*b*, and is retained axially by the bushing assemblies 1310*a* and 1310*b*.

Figure 9:
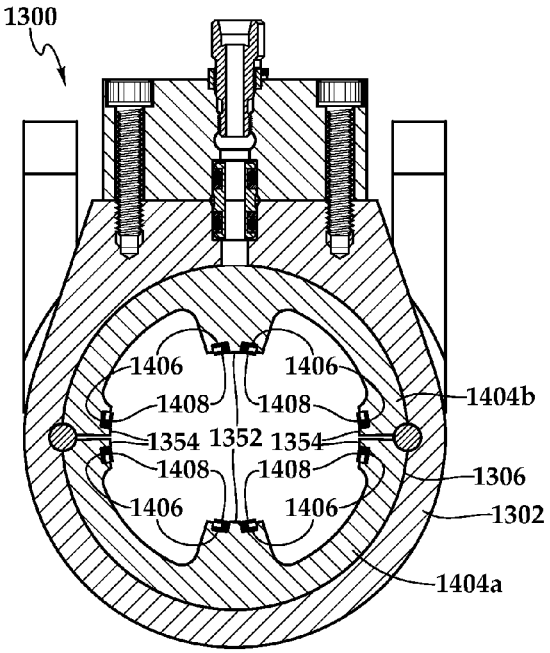
FIG. 9 is an end cross-sectional view of the second example rotary actuator without a rotor.

FIG. 9 is an end cross-sectional view of the example rotary actuator 1300 without the rotor 1304 shown. In this view, the cross-section is taken across an area near the mid-section of the rotary actuator 1300. In this view, the static pistons 1404*a*, 1404*b* are visible in their assembled positions within the bore 1306 of the housing 1302. The continuous seals 1408 are visible within the continuous seal grooves 1406. In this view, the cross-sections of the continuous seals 1408 are located at the inner vanes 1352 and the outer vanes 1354. In some implementations, the inner vanes 1352 can extend an inward perpendicular distance from the two interior partial cylindrical surfaces of the static pistons 1404*a*, 1404*b* such that portions of the continuous seals 1408 disposed in the continuous seal grooves 1406 in the through faces of the inner vanes 1352 will contact the first diameter 1422 of the rotor 1304.

Figure 10:
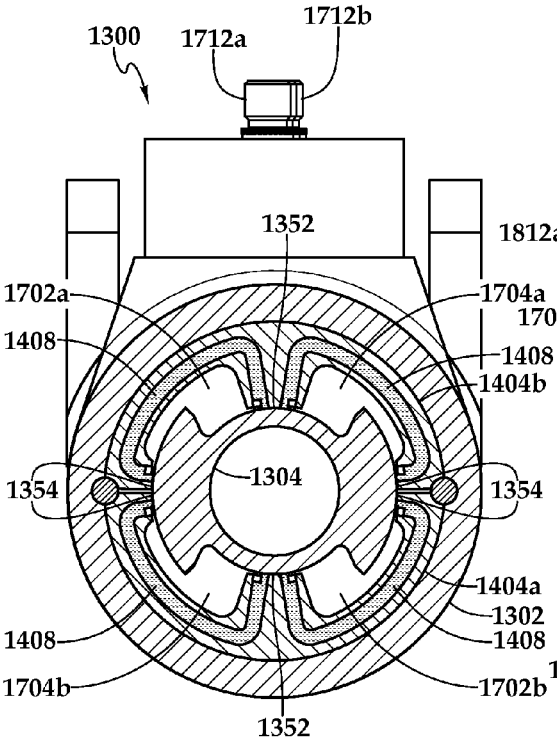
FIG. 10 is an end cross-sectional view of the second example rotary actuator with a rotor.

FIG. 10 is an end cross-sectional view of the example rotary actuator 1300 with the rotor 1304. In this view, the cross-section is taken across an area just inside a proximal end section 1350 of the rotary actuator 1300. In this view, the static pistons 1404*a*, 1404*b* are visible in their assembled positions within the bore 1306 of the housing 1302. The continuous seals 1408 are visible within the continuous seal grooves 1406. In this view, the sections of the continuous seals 1408 are shown extending from the inner vanes 1352, along a proximal end of the static pistons 1404*a*, 1404*b*, to the outer vanes 1354 contacting surface of rotor 1304 first diameter 1422 and second diameter 1424 at respective ends.

In this configuration, axial portions of the continuous seals 1408 are brought into contact with the rotor 1304, and end portions of the continuous seals 1408 are brought into contact with the interior surfaces of the end sections 1350. The assemblage of the rotor 1304, the static pistons 1404*a*, 1404*b*, and the continuous seals 1408 form four pressure chambers 1702*a*, 1702*b*, 1704*a*, and 1704*b*. Opposing pair of pressure chambers 1702*a* and 1702*b* are in fluid communication with a fluid port 1712*a*, and opposing pair of pressure chambers 1704*a* and 1704*b* are in fluid communication with a first fluid port 1712*b*. In some implementations, the fluid ports 1712*a* and 1712*b* can be the fluid ports 1312 of FIG. 6.

Figure 11A:
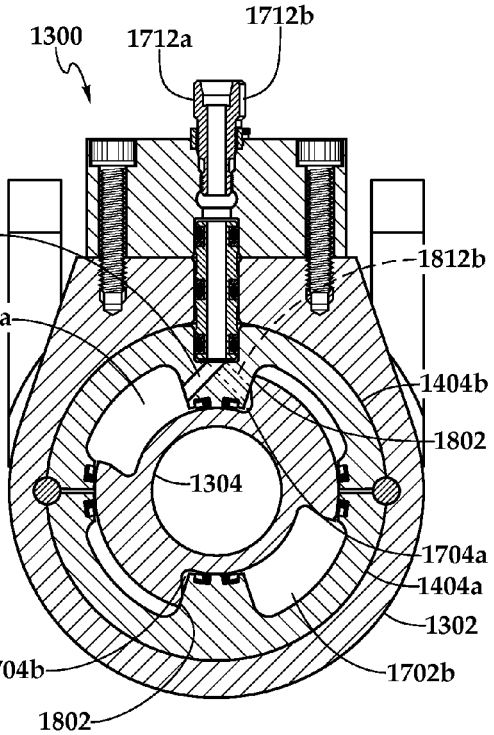
FIGS. 11A-11C are cross-sectional views of the second example rotary actuator in various operational positions.
Figure 11B:
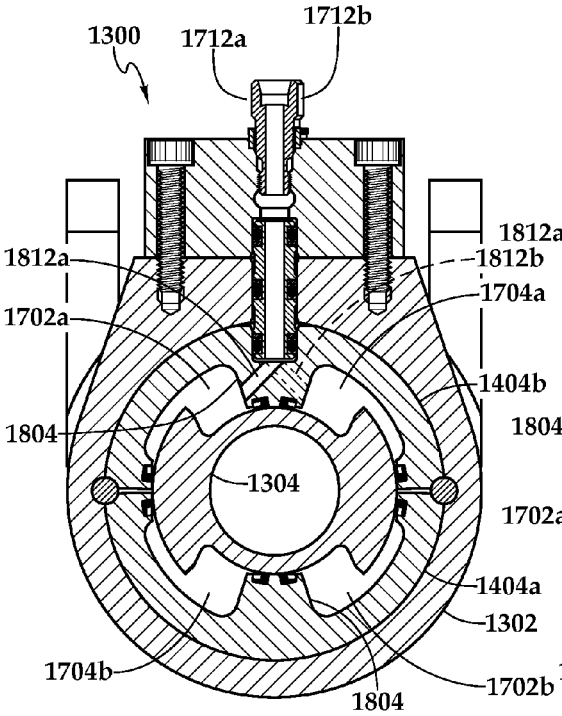
Figure 11C:
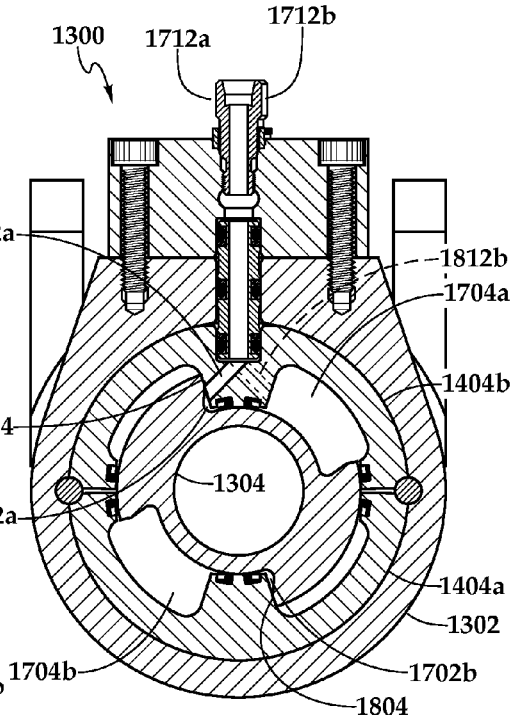

FIGS. 11A-11C are cross-sectional views of the rotary actuator 1300 in various operational positions. Referring to FIG. 11A, the rotary actuator 1300 is shown with the static pistons 1404*a* and 1404*b* assembled with the housing 1302. The rotor 1304 is assembled with the static pistons 1404*a* and 1404*b* at a substantially counterclockwise rotational limit, a counterclockwise hard stop 1802.

Fluid is applied to the fluid port 1712*b*, which fluidly connects to the pressure chambers 1704*a*, 1704*b* through a fluid passage 1812*b*. The pressure chambers 1702*a*, 1702*b* are fluidly connected to the fluid passage 1712*a* through a fluid port 1812*a*.

As fluid is applied to the fluid port 1712*b*, the pressure increases in pressure chambers 1704*a*, 1704*b* and fluid exhaust from fluid chambers 1702*a*, 1702*b* through fluid port 1712*a* to urge the rotor 1304 to turn in a clockwise direction. FIG. 11B shows the rotary actuator 1300 in which the rotor 1304 is in a partly rotated position. As fluid fills to expand the pressure chambers 1704*a*, 1704*b* and urge the rotor 1304 to turn, the pressure chambers 1702*a*, 1702*b* are proportionally reduced. The fluid occupying the pressure chambers 1702*a*, 1702*b* is urged though the fluid port 1812*a* and out the fluid port 1712*a*. In some implementations, the rotor 1304 can be held in substantially any rotational position by blocking the fluid ports 1712*a*, 1712*b*. In some implementations, fluid ports can be simultaneously blocked by a flow control valve in the hydraulic circuit. The continuous seals block the cross fluid chamber leakage.

As fluid continues to be applied to the fluid port 1712*b*, the rotor 1304 continues to rotate relative to the static pistons 1404*a*, 1404*b*, until the rotor 1304 encounters a substantially clockwise rotational limit, a clockwise hard stop 1804. Referring now to FIG. 11C, the rotary actuator 1300 is shown where the rotor 1304 is at a substantially clockwise rotational limit, at the clockwise hard stop 1804. This rotational process can be reversed by applying fluid at the fluid port 1712*a* to fill the pressure chambers 1702*a*, 1702*b* and exhausting fluid from pressure chambers 1704*a*, 1704*b* through fluid port 1712*b* to urge the rotor 1304 to rotate counterclockwise.

Although in FIGS. 6-11C the static pistons 1404*a*, 1404*b* are illustrated as being in two parts, in some embodiments, three, four, five, or more static pistons may be used in combination with a correspondingly formed rotor.

Figure 12:
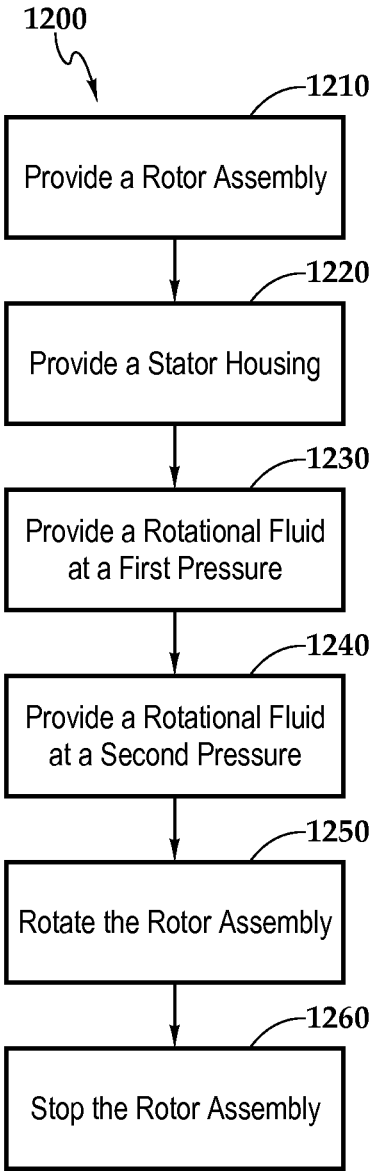
FIG. 12 is a flow diagram of an example process for rotating a hydraulic blocking rotary actuator with continuous rotary piston seals.

FIG. 12 is a flow diagram of an example process 1200 for rotating a hydraulic blocking rotary actuator (e.g., the first embodiment hydraulic blocking rotary actuator 1000 of FIGS. 3A-5D, and the second embodiment hydraulic blocking rotary actuator 1300 of FIGS. 6A-11C). More particularly with regard to the first embodiment, at step 1210, a rotor assembly 1100, the rotor 1008 and the rotary pistons 1004*a*-1004*d* are provided. The rotor assembly includes a rotor hub (e.g., rotor hub 1008, 1304) adapted to connect to an output shaft, and has at least two opposing rotary piston assemblies (e.g., rotary piston assemblies 1108) disposed radially on the rotor hub. Each of the rotary piston assemblies includes a first vane disposed substantially perpendicular to a longitudinal axis of the rotor (e.g., the elongated vanes 1106), and a corresponding one of the continuous seals (e.g., seals 1006*a*-1006*d*) that rides uninterrupted on the inside of a seal groove. In some implementations, the output shaft can be configured to connect to a rotary valve stem.

At step 1220, a stator housing (e.g., the stator housing 1002) is provided. The stator housing has a middle chamber portion including an opposing pair of arcuate ledges (e.g., hard stops 1204) disposed radially inward along the perimeter of the chamber, each of said ledges having a first terminal end and a second terminal end. In some implementations, the stator housing can be adapted for connection to a valve housing.

At step 1230, a rotational fluid is provided at a first pressure and contacting the first vane with the first rotational fluid. For example, hydraulic fluid can be applied through the fluid port 1210 to the chambers 1202*a*.

At step 1240, a rotational fluid is provided at a second pressure less than the first pressure and contacting the second vane with the second rotational fluid. For example, as the rotor assembly rotates clockwise, fluid in the fluid chambers 1202*a* is displaced and flows out through the fluid port 1212.

At step 1250, the rotor assembly is rotated in a first direction of rotation. For example, FIGS. 5A-5D illustrate the rotor assembly 1100 being rotated in a counterclockwise direction.

At step 1260, the rotation of the rotor assembly is stopped by contacting the first terminal end of the first ledge with the first vane and contacting the second terminal end of the first ledge with the second vane. For example, FIG. 5D illustrates the rotor assembly 1100 with the elongated vanes 1106 in contact with hard stops 1204.

In some implementations, the rotor assembly can be rotated in the opposite direction to the first direction of rotation by increasing the second pressure and reducing the first pressure until the second pressure is greater than the first pressure. In some implementations, the rotation of the rotor assembly in the opposite direction can be stopped by contacting the first terminal end of the first ledge with the second vane and contacting the second terminal end of the first ledge with the first vane.

In some implementations, the first terminal end can include a first fluid port formed therethrough and the second terminal end can include a second fluid port formed therethrough. Rotational fluid at a first pressure can be provided through the first fluid port and rotational fluid at a second pressure can be provided through the second fluid port. For example, fluid can be applied at the fluid port 1210 and flowed to the chambers 1202*a* through fluid ports (not shown) formed in the hard stops 1204. Similarly, fluid can be applied at the fluid port 1212 and flowed through fluid ports (not shown) formed in the hard stops 1204.

With regard to the second embodiment, at step 1210, the rotor 1304 is provided. The rotor 1304 includes the end sections 1350 formed about the axis of the rotor 1304 with a diameter substantially similar to, but smaller than, that of the through bore 1306. The second diameter 1424 is formed about the axis of the rotor 1304 with a radial diameter smaller than that of the end sections 1350. The first diameter 1422 is formed about the axis as a pair of substantially diametrically opposed quarter sector recesses, in which the radial diameter of the first diameter 1422 is smaller than that of the second diameter 1424. In some implementations, the rotor 1304 can be configured to connect to the hinge line of a flight control surface.

At step 1220, a stator housing (e.g., the stator housing 1302) is provided. The housing 1302 is generally formed as a cylinder with a central bore 1306. The rotor 1304 and the static piston assemblies 1404*a*-1404*b* are assembled with the housing 1302 by inserting the rotor 1304 and the static pistons assemblies 1404*a*-1404*b* into the through bore 1306 from a housing end 1308*a* or a housing end 1308*b*.

At step 1230, a rotational fluid is provided at a first pressure and contacting the first inner vane side of a static piston while acting against the differential area created by the height difference between the first diameter 1422 and second diameter 1424 of the rotor 1304 with the first rotational fluid. For example, hydraulic fluid can be applied through the fluid port 1712*b* to the chambers 1704*a*.

At step 1240, a rotational fluid is provided at a second pressure less than the first pressure and contacting the second inner vane side of a second static piston while acting against the differential area created by the height difference between the first diameter 1422 and second diameter 1424 of the rotor 1304 with the second rotational fluid. For example, as the rotor 1304 rotates clockwise, fluid in the fluid chambers 1702*a* is displaced and flows out through the fluid port 1712*a*.

At step 1250, the rotor 1304 is rotated in a first direction of rotation. For example, FIGS. 11A-11C illustrate the rotor 1304 being rotated in a clockwise direction.

At step 1260, the rotation of the rotor 1304 is stopped by contacting an edge of the second diameter 1424 with the inner vane of the static piston. For example, FIG. 11C illustrates the rotor 1304 with an edge of the second diameter 1424 in contact with hard stops 1804.

In some implementations, the rotor can be rotated in the opposite direction to the first direction of rotation by increasing the second pressure and reducing the first pressure until the second pressure is greater than the first pressure. In some implementations, the rotation of the rotor in the opposite direction can be stopped by contacting an edge of the second diameter 1424 and contacting the hard stop 1802.

In some implementations, the first terminal end can include a first fluid port formed therethrough and the second terminal end can include a second fluid port formed therethrough. Rotational fluid at a first pressure can be provided through the first fluid port and rotational fluid at a second pressure can be provided through the second fluid port. For example, fluid can be applied at the fluid port 1712*a* and flowed to the chambers 1702*a* through fluid ports formed in the hard stops 1804. Similarly, fluid can be applied at the fluid port 1712*b* and flowed through fluid ports formed in the hard stops 1802.

Although a few implementations have been described in detail above, other modifications are possible. Accordingly, other implementations are within the scope of the following claims.

What is claimed is:

1. A hydraulic rotary actuator comprising:

a stator housing comprising a seamless body having a bore disposed axially therethrough, the bore having:
- a first end bore portion having a first diameter;
- a second end bore portion having a second diameter; and
- at least a middle bore portion disposed between the first end bore portion and the second end bore portion, said middle bore portion having:
  - a first semi-cylindrical surface having a third diameter larger than the first diameter;
  - a second semi-cylindrical surface having a fourth diameter less than the third diameter and larger than at least one of the first diameter and the second diameter, wherein the second semi-cylindrical surface is disposed inward radially along a portion of a perimeter of the middle bore;
  - a first interior end surface between the middle bore portion and the first end bore portion; and
  - a second interior end surface between said second bore portion and the middle bore portion;

a rotor assembly comprising:
- an output shaft;
- a first rotary piston member disposed radially about the output shaft, said first rotary piston member having:
  - a vane,
  - a portion adapted to connect to the output shaft when the first rotary piston member is disposed radially about the output shaft,
  - a first peripheral longitudinal face,
  - a second peripheral longitudinal face, said second peripheral longitudinal face positioned axially on the vane,
  - a first peripheral lateral face,
  - a second peripheral lateral face, and
  - a first continuous seal disposed on the first and second peripheral longitudinal faces and the first and second peripheral lateral faces of the first rotary piston member; and
- a second rotary piston member disposed radially about the output shaft, said second rotary piston member having:
  - a vane,
  - a portion adapted to connect to the output shaft when the second rotary piston member is disposed radially about the output shaft,
  - a third peripheral longitudinal face,
  - a fourth peripheral longitudinal face, said fourth peripheral longitudinal face positioned axially on the vane,
  - a third peripheral lateral face,
  - a fourth peripheral lateral face, and
  - a second continuous seal disposed on the third and fourth peripheral longitudinal faces and the third and fourth peripheral lateral faces of the second rotary piston member;

wherein when the rotor assembly is assembled and rotated in the bore of the stator housing, a portion of the first continuous seal positioned on the first peripheral longitudinal face contacts the second semi-cylindrical surface of the middle bore portion, a portion of the first continuous seal positioned on the second peripheral longitudinal face contacts the first semi-cylindrical surface of the middle bore portion, a portion of the first continuous seal positioned on the first peripheral lateral face contacts the first interior end surface, and a portion of the first continuous seal positioned on the second peripheral face contacts the second interior end surface.

2. The actuator of claim 1 wherein the vane of the first rotary piston member and the vane of the second rotary piston member are disposed longitudinally adjacent to each other and parallel to a longitudinal axis of the output shaft.

3. The actuator of claim 1 wherein each of the rotary piston members is adapted to pass through the first end bore portion before being coupled to the rotor output shaft in the middle bore portion.

4. The actuator of claim 3 wherein the portions of the rotary piston members include a plurality of slots adapted to receive a plurality of teeth on the output shaft thereby coupling the rotary piston members to the output shaft.

5. The actuator of claim 1 wherein at least one of the first continuous seal and the second continuous seal is selected from the group consisting of an O-ring, an X-ring, a Q-ring, a D-ring, and an energized seal.

6. The rotary actuator of claim 1 wherein the first rotary piston member and the second rotary piston member and the stator housing define two adjacent pressure chambers inside of the middle bore portion.

7. The actuator of claim 1 wherein a first external pressure source provides a fluid at a first pressure for contacting the vane of the first rotary piston member and a second external pressure source provides a fluid at a second pressure for contacting the vane of the second rotary piston member.

8. The actuator of claim 1 further including a third rotary piston member and a fourth rotary piston member each including a respective vane member, and wherein the stator housing and the first, second, third and fourth rotary piston members define four pressure chambers.

9. The actuator of claim 1 wherein the output shaft is configured to connect to a rotary valve stem.

10. The actuator of claim 1 wherein the output shaft is adapted for connection to an aircraft control surface.

11. The actuator of claim 8 wherein the first semi-cylindrical surface disposed inward radially along a portion of the middle bore includes a first terminal end adapted to contact the vane of the second rotary piston member.

12. The actuator of claim 11 wherein the middle bore portion includes a second semi-cylindrical surface disposed inward radially along a portion of the middle bore portion and opposite the first semi-cylindrical surface, said second semi-cylindrical surface having a first terminal end adapted to contact the vane of the first rotary piston member.

13. The actuator of claim 12 wherein the vanes of the first and second rotary piston members and the two semi-cylindrical surfaces are configured to define opposing pressure chambers.

14. The actuator of claim 13 wherein each pair of opposing pressure chambers defined by the housing and rotor have equal surface areas as the rotor assembly rotates within the housing.

15. The actuator of claim 13 wherein a first pair of opposing pressure chambers is adapted to be connected to a first external pressure source and a second pair of opposing pressure chambers is adapted to be connected to a second external pressure source.

16. The actuator of claim 15 wherein the first external pressure source provides a fluid at a first pressure for contacting the vane of the first rotary piston member and the second external pressure source provides a fluid for contacting the vane of the second rotary piston member.

17. The actuator of claim 12 wherein the first terminal end of the first semi-cylindrical surface further includes a first fluid port formed therethrough and the first terminal end of the second semi-cylindrical surface includes a second fluid port formed therethrough and the first fluid port is connected to a fluid provided at a first pressure and the second fluid port is connected to a fluid provided at a second pressure.

18. The actuator of claim 1 wherein the first diameter is greater than or equal to the second diameter.

19. The actuator of claim 1 wherein the second diameter is greater than or equal to the first diameter.

20. A method of rotary actuation comprising:

providing a stator housing comprising a seamless body having a bore disposed axially therethrough, the bore having a first end bore portion having a first diameter, a second end bore portion having a second diameter, and at least a middle bore portion disposed between the first end bore portion and the second end bore portion, said middle bore portion having a first semi-cylindrical surface having a third diameter larger than the first diameter, a second semi-cylindrical surface having a fourth diameter less than the third diameter and larger than at least one of the first diameter and the second diameter, wherein the second semi-cylindrical surface is disposed inward radially along a portion of a perimeter of the middle bore, a first interior end surface between the middle bore portion and the first end bore portion, and a second interior end surface between said second bore portion;

providing a rotor assembly comprising:

an output shaft, a first rotary piston member disposed radially about the output shaft, said first rotary piston member having:

a vane, a portion adapted to connect to the output shaft when the first rotary piston member is disposed radially about the output shaft, a first peripheral longitudinal face, a second peripheral longitudinal face, said second peripheral longitudinal face positioned axially on the vane, a first peripheral lateral face, a second peripheral lateral face, a first continuous seal disposed on the first and second peripheral longitudinal faces and the first and second peripheral lateral faces of the first rotary piston member; and a second rotary piston member disposed radially about the output shaft, said second rotary piston member having:

a vane, a portion adapted to connect to the output shaft when the second rotary piston member is disposed radially about the output shaft, a third peripheral longitudinal face of the rotary piston member, a fourth peripheral longitudinal face of the rotary piston member, said fourth peripheral longitudinal face positioned axially on the vane, a third peripheral lateral face, a fourth peripheral lateral face, and a second continuous seal disposed on the third and fourth peripheral longitudinal faces and the third and fourth peripheral lateral faces of the second rotary piston member;

providing a first fluid at a first pressure and contacting the vane of the first rotary piston member with the first fluid;

providing a second fluid at a second pressure and contacting the vane of the second rotary piston member; and rotating the rotor assembly in a first direction of rotation such that when the rotor assembly is rotated in the bore of the stator housing, a portion of the first continuous seal positioned on the first peripheral longitudinal face contacts the second semi-cylindrical surface of the middle bore portion, a portion of the first continuous seal positioned on the second peripheral longitudinal face contacts the first semi-cylindrical surface of the middle bore portion, a portion of the first continuous seal positioned on the first peripheral lateral face contacts the first interior end surface, and a portion of the first continuous seal positioned on the second peripheral face contacts the second interior end surface.

21. The method of claim 20 further including:

increasing the second pressure and reducing the first pressure until the second pressure is greater than the first pressure; and rotating the rotor assembly in an opposite direction to the first direction of rotation.

22. The method of claim 21 further including:

stopping the rotation of the rotor assembly in the opposite direction by contacting a first terminal end of the first semi-cylindrical surface with the vane of the second rotary piston member.

23. The method of claim 20 wherein the first rotary piston member and a second rotary piston member isolates the first fluid and second fluid into a first chamber and a second chamber adjacent to the first chamber, and the method further comprises:

providing the first fluid at the first pressure to a first chamber; and providing the second fluid at the second pressure to a second chamber.

24. The method of claim 20, wherein a first terminal end of the first semi-cylindrical surface further includes a first fluid port formed therethrough and a first terminal end of a second semi-cylindrical surface includes a second fluid port formed therethrough, and wherein providing the first fluid at a first pressure is provided through the first fluid port and providing the second fluid at a second pressure is provided through the second fluid port.

25. The method of claim 21, further comprising stopping the rotation of the rotor assembly by contacting a first terminal end of a second semi-cylindrical surface with the vane of the second rotary piston member.

26. A method of assembling a hydraulic rotary actuator comprising:

providing a stator housing comprising a seamless body having a bore disposed axially therethrough, the bore having a first end bore portion having a first diameter, a second end bore portion having a second diameter, and at least a middle bore portion disposed between the first end bore portion and the second end bore portion, said middle bore portion having a third diameter larger than the first diameter and a semi-cylindrical surface of the middle bore, and a first interior end surface between the middle bore portion and the first end bore portion, and a second interior end surface between said second bore portion and the middle bore portion, said middle bore further including a first arcuate ledge disposed inward radially along a portion of a perimeter of the middle bore, said arcuate ledge having a fourth diameter less that the third diameter of the middle bore and a semi-cylindrical surface;

inserting a first rotary piston member through the first end bore portion of the housing and positioning the first rotary piston member in the middle bore portion of the housing, said first rotary piston member including:

a vane, a portion adapted to connect to a rotor output shaft when the first rotary piston member is disposed radially about the rotor output shaft, a first peripheral longitudinal face of the first rotary piston member, a second peripheral longitudinal face of the first rotary piston member, said second peripheral longitudinal face positioned axially on the vane, a first peripheral lateral face, a second peripheral lateral face, a first continuous seal groove disposed in the first and second peripheral longitudinal faces and the first and second peripheral lateral faces of the first rotary piston member, and a first continuous seal disposed in the first continuous seal groove;

inserting a second rotary piston member through either the first end bore portion or the second end bore portion of the housing and positioning the second rotary piston member in the middle bore portion of the housing with a vane longitudinally adjacent to the vane of the first rotary piston member, said second rotary piston member further including:

a second portion adapted to connect to the rotor output shaft when the second rotary piston member is disposed radially about the rotor output shaft, a first peripheral longitudinal face of the second rotary piston assembly, a second peripheral longitudinal face of the second rotary piston member, said second peripheral longitudinal face positioned axially on the vane, a first peripheral lateral face, a second peripheral lateral face, a second continuous seal groove disposed on the first and second peripheral longitudinal faces and the first and second peripheral lateral faces of the second rotary piston member; and a second continuous seal disposed in the second continuous seal groove;

inserting the rotor output shaft through at least one of the first end bore portion and the second end bore portion, and the middle bore portion of the housing; and coupling the vane of the first rotary piston member and the vane of the second rotary piston member to the rotor output shaft when the rotor output shaft is positioned longitudinally inside the housing.

27. The method of claim 26, wherein a portion of the first continuous seal positioned on the first peripheral longitudinal face contacts the semi-cylindrical surface of the middle bore portion, a portion of the first continuous seal positioned on the second peripheral longitudinal face contacts the semi-cylindrical surface of the arcuate ledge, a portion of the first continuous seal positioned on the first peripheral lateral face contacts the first interior end surface, and a portion of the first continuous seal positioned on the second peripheral face contacts the second interior end surface.

* * * * *